US005984460A

United States Patent [19]

Takagi et al.

[11] Patent Number: 5,984,460

[45] Date of Patent: Nov. 16, 1999

[54] INK TANK AND RECORDING APPARATUS

[75] Inventors: Jun Takagi; Katsuhide Ogawa; Katsuyuki Fujii; Kazuyuki Oda; Junichi Yoshida, all of Ebina, Japan

[73] Assignee: Fuji Xerox Co., Ltd., Tokyo, Japan

[21] Appl. No.: 08/628,884

[22] Filed: Apr. 5, 1996

[30] Foreign Application Priority Data

Apr. 10, 1995 [JP] Japan ..... 7-83622
Feb. 20, 1996 [JP] Japan ..... 8-32243

[51] Int. Cl.[6] ..... B41J 2/175

[52] U.S. Cl. ..... 347/86; 347/87

[58] Field of Search ..... 347/86, 87, 85

[56] References Cited

U.S. PATENT DOCUMENTS

| | | | |
|---|---|---|---|
| 4,126,868 | 11/1978 | Kirner | 347/86 |
| 4,771,295 | 9/1988 | Baker et al. | 347/86 |
| 4,931,811 | 6/1990 | Cowger et al. | 347/86 |
| 5,025,271 | 6/1991 | Baker et al. | 347/87 |

FOREIGN PATENT DOCUMENTS

| | | |
|---|---|---|
| A-0-408-241 | 1/1991 | European Pat. Off. . |
| A-0-578-330 | 1/1994 | European Pat. Off. . |
| A-0-589-540 | 3/1994 | European Pat. Off. . |
| A-0-633-138 | 1/1995 | European Pat. Off. . |
| A-0-665-109 | 8/1995 | European Pat. Off. . |
| A-63-87242 | 4/1988 | Japan . |
| B2-5-23954 | 4/1993 | Japan . |
| A-6-15837 | 1/1994 | Japan . |

*Primary Examiner*—Peter S. Wong
*Assistant Examiner*—Bao Q. Vu
*Attorney, Agent, or Firm*—Oliff & Berridge, PLC

[57] ABSTRACT

In an ink tank, there are provided a main ink chamber containing a capillary vessel member, and an intermediate ink chamber. When the ink is consumed, the ink held by capillary force of a capillary vessel member is supplied via a communication port from a joint port. The same amount of air as the amount of the consumed ink is conducted from the atmospheric communication port into the main ink chamber. The conducted ink is supplied via a groove formed in a lid to an upper surface of the capillary vessel member. As a result, the air is entered into the capillary vessel member under better condition. In a plane portion of the lid, the ink is in contact with only the capillary vessel member, and the ink remaining this portion is reduced. Thus, the ink using efficiency is increased.

32 Claims, 14 Drawing Sheets

INK TANK AND RECORDING APPARATUS

BACKGROUND OF THE INVENTION

The present invention relates to an ink tank for supplying ink to a print head, and to a recording apparatus with employment of this ink tank.

Conventionally, as the ink supply mechanism employed in the recording apparatus for recording by ink, as described in, for example, Japanese Laid-open Patent Application No. 63-87242, and U.S. Pat. No. 5,025,271, such an ink supply mechanism has been proposed that the porous member is arranged within the ink tank, one end of this porous member is coupled via the filter to the print head, and the other end thereof is provided with the air intake port. In the ink supply mechanism described in this publication, compression force is given to the foam corresponding to the porous member within the vessel by the tab. However, such an arrangement has a problem that the capillary force of the foam would be increased at the depression unit of the foam by the tab, and the ink may readily remain in the foam. Also, there is a design limitation such that to apply the proper compression force, the above-described arrangement could not be realized unless the ink dipped member per se is the elastic member.

Another conventional technique is described in, for instance, Japanese Patent Publication No. 5-23954. That is, in this ink tank, the projection portion is formed which constitutes the space between the inner wall surface of the ink tank and the ink dipped member. Furthermore, this ink tank includes means for communicating this space with the atmosphere. However, when the space is formed by the projection unit, the capillary vessel force of the ink dipped member would be similarly increased at the contact point between the projection unit and the ink dipped member. Thus, there is another problem that the ink may readily remain in the ink dipped member.

Furthermore, Japanese Laid-open Patent Application No. 6-15837 discloses the means having the projection portion around the atmospheric communication port in order that the ink does not dip into the atmospheric communication port. However, also in this case, the capillary vessel force of the porous member would be increased at the contact point between the projection portion and the ink-dipped porous member. Thus, there is a problem that the ink may readily remain in the porous material. Moreover, the porous member concaving with the projection portion may easily form the unwanted space between the inner wall surface of the ink tank and therewith. Accordingly, there is a risk to release negative pressure in the ink tank.

SUMMARY OF THE INVENTION

The present invention has been made in an attempt to solve the above-described problems, and therefore, has an object to provide an ink tank capable of increasing an ink using efficiency, and a recording apparatus with employment of this ink tank.

The invention as recited in aspect 1 is characterized by that in an ink tank connected to a print head, a concave portion communicated to an atmospheric communication hole is formed in an inner wall surface for storing therein a capillary vessel member build in the ink tank; and a space to which air communicates is formed between the concave portion and the inner wall of the ink tank.

The invention, as recited in aspect 2, is characterized by that in an ink tank connected to a print head, a concave portion communicated to an atmospheric communication hole is formed on the side of a capillary vessel member build in the ink tank; and a space to which air communicates is formed between the concave portion and the inner wall of the ink tank.

The invention, as recited in aspect 3, is characterized by that in an ink tank connected to a print head, the ink tank is comprised of:

an ink chamber capable of reservoiring therein the ink;

a communication port provided at a portion of the ink chamber, for conducting the ink reservoired in the ink chamber;

an atmospheric communication port provided at a portion of a wall of the ink chamber, communicated with an external atmosphere, and for supplying the external atmosphere to an inside of the ink chamber; and a capillary vessel member stored within the ink chamber, capable of dipping the ink; wherein:

a concave portion is formed in a peripheral surface containing the atmospheric communication port within the wall of the ink chamber; and the atmospheric communication port is isolated from the capillary vessel member by way of an air layer existing in the concave portion.

The invention, as recited in aspect 4, is characterized by that in the ink tank as in aspect 3, a portion of the peripheral surface of the ink chamber containing the atmospheric communication port except the concave portion does not compress the capillary vessel member.

The invention, as recited in aspect 5, is characterized by that in the ink tank as in aspect 3, a compression degree of the capillary vessel member near the atmospheric communication port is lower than, or equal to a compression degree of the capillary vessel member near a center portion thereof.

The invention, as recited in aspect 6, is characterized by that in the ink tank as in aspect 3, the concave portion is provided at a portion of a surface located opposite to such a surface where the communication port of the ink chamber is formed.

The invention, as recited in aspect 7, is characterized by that in the ink tank as in aspect 3, the atmospheric communication port is provided on an upper surface of the ink chamber; and the concave portion provided around the atmospheric communication port is a groove formed along a longitudinal direction of the ink chamber.

The invention, as recited in aspect 8, is characterized by that in the ink tank as in aspect 3, an area of the concave portion is equal to an approximately half of an area of the surface where the atmospheric communication port of the ink chamber.

The invention, as recited in aspect 9, is characterized by that in the ink tank for supplying ink to a print head, the ink tank is comprised of:

a capillary vessel member capable of dipping ink;

a lid in which an atmospheric communication port for supplying atmosphere, and a groove is formed around the atmospheric communication port of one surface thereof; and an ink chamber for holding the capillary vessel member therein, where a communication port for conducting the ink is provided in a lower portion thereof, and the groove is mounted in such a manner that a surface containing the groove provided on the lid is located inside; wherein:

the atmospheric communication port is isolated from the capillary vessel member by an air layer existing in the groove, while being in contact with the capillary vessel member at a portion of the surface containing the groove of the lid other than the groove.

The invention, as recited in aspect 10, is characterized by that in the ink tank as in aspect 9, the capillary vessel member is not compressed by a portion of the opposite surface of the lid other than the groove.

The invention, as recited in aspect 11, is characterized by that in the ink tank as in aspect 9, a compression degree of the capillary vessel member near the atmospheric communication port is lower than, or equal to a compression degree of the capillary vessel member near a center portion thereof.

The invention, as recited in aspect 12, is characterized by that in an ink tank for supplying ink to a print head, the ink tank is comprised of:

an ink chamber capable of reservoiring therein the ink;

a communication port provided at a portion of the ink chamber, for conducting the ink reservoired in the ink chamber;

an atmospheric communication port provided at a portion of a wall of the ink chamber, communicated with an external atmosphere, and for supplying the external atmosphere to an inside of the ink chamber; and a capillary vessel member stored within the ink chamber, capable of dipping the ink; wherein:

a concave portion is formed in a peripheral surface containing the atmospheric communication port within the wall of the ink chamber; and the atmospheric communication port is isolated from the capillary vessel member by way of an air layer existing in the concave portion.

The invention, as recited in aspect 13, is characterized by that in the ink tank as in aspect 12, the wall in which the atmospheric communication hole is a portion of a lid.

The invention, as recited in aspect 14, is characterized by that in the ink tank as in aspect 12, or 13, the surface having the concave portion of the capillary vessel member is not compressed by the surface of the opposite wall.

The invention, as recited in aspect 15, is characterized by that in the ink tank as in aspect 12, or 13, a compression degree of the capillary vessel member near the atmospheric communication port is lower than, or equal to a compression degree of the capillary vessel member near a center portion thereof.

The invention, as recited in aspect 16, is characterized by that in the ink tank as in any one of the preceding aspects 1 to 15, the ink tank includes a meniscus forming member formed on the communication port, arranged in contact with the capillary vessel member, and in which a plurality of very small holes are formed.

The invention, as recited in aspect 17, is characterized by that in the ink tank as in aspect 16, the ink tank further comprises:

an intermediate ink chamber corresponding to a small chamber under highly sealing condition; and a communication path communicated to the communication port of the ink chamber, the intermediate ink chamber, and the print head.

The invention, as recited in aspect 18, is characterized by that in the ink tank as in any one of the preceding aspects 1–17, the capillary vessel member is a porous material.

The invention, as recited in aspect 19, is characterized by that in the ink tank as in any one of the preceding aspects 1–17, the capillary vessel member is a three-dimensionally branched filaments.

The invention, as recited in aspect 20, is characterized by that in the ink tank as in any one of the preceding aspects 1–17 wherein:

the capillary vessel member is a material spun in a three-dimensional shape.

The invention, as recited in aspect 21, is characterized by that in the ink tank as in any one of the preceding aspects 1–17, the capillary vessel member is a bundled fiber material.

The invention, as recited in aspect 22, is featured by a recording apparatus characterized by employing the ink tank as in any one of the preceding aspects 1 to 21.

According to the invention as recited in aspects 1 and 2, since the concave portion communicated to the atmosphere is provided, this concave portion causes the space through which the air passes to be formed between the inner wall of the ink tank and the concave portion, and the capillary vessel member can be made in better contact to the air. Also, no compression force is locally given to the capillary vessel member. At this time, when the concave portion is made wide, the contact area between the capillary vessel member and the air is increased, and then the air can be uniformly entered into the capillary vessel member.

In accordance with the invention recited in aspect 3, the ink is dipped/held in the capillary vessel member stored in the ink chamber, and the ink is conducted from the atmospheric communication port into, for example, the print head. The concave portion is provided at the peripheral surface containing the atmospheric communication port within the ink chamber, and the atmospheric communication port is isolated from the capillary vessel member at this portion. As a result, the air entered from the atmospheric communication port into the ink chamber is spread over the entire concave portion. The air is entered from the portion of the concave portion into the capillary vessel member in connection with consumption of the ink. At this time, when the concave portion is made wider, the contact area between the capillary vessel member and the air is increased, and then the air can be uniformly entered into the capillary vessel member. Since the surface of the ink chamber is made in contact with the surface of the capillary vessel member at the portion other than the concave portion, the surface is not depressed at one point as the tab. Accordingly, the capillary vessel force is not increased at this portion. Therefore, the atmosphere can be properly supplied to the capillary vessel member of the ink chamber, and there is few ink left in the capillary vessel member, so that the ink dipped into the capillary vessel member employed in the ink chamber can be effectively utilized at maximum.

In particular, according to the present invention as recited in aspect 4, it is so arranged that the portion of the peripheral surface of the ink chamber containing the atmospheric communication port except for the concave portion does not compress the capillary vessel member. Thus, without increasing the capillary vessel force of this portion, the atmosphere can be properly supplied to the capillary vessel member. The amount of the ink left in this portion can be decreased, and the utilization efficiency of the ink can be improved.

According to the invention as recited in aspect 5, it is so arranged that the compression degree of the capillary vessel member near the atmospheric communication port is lower than, or equal to the compression degree of the capillary vessel member near a center portion thereof. Accordingly, the ink is not left near the atmospheric communication port of the capillary vessel member, but is moved to such a portion which compression degree is higher, so that the ink remaining amount is decreased and the ink utilization efficiency can be improved.

According to the present invention as recited in aspect 6, the concave portion is provided at a portion of a surface located opposite to such a surface where the communication port of the ink chamber is formed. Since the air is entered from the portion opposite to the concave portion into the capillary vessel member, the ink is used from the portion far from the communication port and the air is entered, so that the ink can be effectively consumed.

According to the invention as recited in aspect 7, since the air communication port is provided in the upper surface of the ink chamber, the air is entered into the capillary vessel member in connection with lowering of the ink surface when the ink is consumed. Thus, the ink can be effectively used. The concave portion formed around the air communication port is formed as the groove extending along the longitudinal direction of the ink chamber. As a result, the air band is fabricated on the upper portion of the capillary vessel member, and the air can be spread above the capillary vessel member in conjunction with consumption of the ink, so that remaining of the ink can be reduced.

In accordance with the invention as recited in aspect 8, an area of the concave portion is equal to an approximately half of an area of the surface where the atmospheric communication port of the ink chamber. As a result, the area where the capillary vessel member is made in contact with the air layer is made large, and no concentrated depression force caused by the surface where the atmospheric communication port is formed is applied. Thus, the amount of remaining ink can be reduced.

In accordance with the invention as recited in aspect 9, the ink chamber is made being mounted with the lid. The atmospheric communication port and the groove are fabricated in this lid. This lid may function similar to the above-described concave portion, and thus the air can be entered from the air layer formed in the groove into the capillary vessel member. As a consequence, the air can be uniformly entered, and the amount of ink left in the capillary vessel member within the ink chamber is reduced, so that the ink dipped into the capillary vessel member within the ink chamber can be utilized in maximum efficiency.

In particular, according to the invention as recited in aspect 10, since it is so arranged that the capillary vessel member is not compressed by the portion other than the groove of the lid. Thus, the amount of ink remaining in the portion of the capillary vessel member made in contact with the portion other than the groove of the lid, so that the ink use efficiency can be improved.

In accordance with the invention as recited in aspect 11, in the structure having the lid, the compression degree of the capillary vessel member near the atmospheric communication port is lower than, or equal to the compression degree of the capillary vessel member near a center portion thereof. Similar to aspect 3, since the ink is not reservoired near the atmospheric communication port of the capillary vessel member, but is transported to the portion whose compression degree is high, the ink remaining amount can be reduced and the ink using efficiency can be improved.

According to the invention as recited in aspect 12, the concave portion is provided on the side of the capillary vessel member. This concave portion may function similar to the above-described concave portion. The air can be entered from the air layer formed in the concave portion into the capillary vessel member. As a result, since the air can be uniformly entered and the amount of ink left in the capillary vessel member within the ink chamber is reduced, so that the ink dipped into the capillary vessel member within the ink chamber can be utilized in maximum efficiency. Also, according to the present invention as recited in aspect 13, the lid is provided with the ink tank, and the atmospheric communication holes formed in this lid are communicated with the concave portion of the capillary vessel member, so that the air can be supplied to the capillary vessel member.

In particular, according to the present invention as recited in aspect 14, it is so arranged that the portion of the peripheral surface of the ink chamber containing the atmospheric communication port except for the concave portion does not compress the capillary vessel member. Thus, without increasing the capillary vessel force of this portion, the atmosphere can be properly supplied to the capillary vessel member. The amount of the ink left in this portion can be decreased, and the utilization efficiency of the ink can be improved.

According to the invention as recited in aspect 15, it is so arranged that the compression degree of the capillary vessel member near the atmospheric communication port is lower than, or equal to the compression degree of the capillary vessel member near a center portion thereof. Accordingly, the ink is not left near the atmospheric communication port of the capillary vessel member, but is moved to such a portion which compression degree is higher, so that the ink remaining amount is decreased and the ink utilization efficiency can be improved.

Also, in accordance with the invention as recited in aspect 16, in the ink tank as in any one of the preceding aspects 1 to 15, the ink tank includes the meniscus forming member formed on the communication port, arranged in contact with the capillary vessel member, and in which a plurality of very small holes are formed. Based upon the pressure produced when the air breaks the meniscus of the ink formed in the very small holes of the meniscus forming member to be entered, namely the bubble point pressure of the meniscus forming member, the upper limit value of the ink pressure within the ink tank is defined. The ink dipped into the capillary vessel member inside the ink chamber can be finally and effectively used by setting the bubble point pressure of the meniscus forming member. The bubbles reached the communication prot is trapped by the meniscus forming member so as to avoid entering of the bubbles into the print head.

Also, in accordance with the invention as recited in aspect 17, the ink tank further comprises the intermediate ink chamber corresponding to the small chamber under highly sealing condition; and the communication path communicated to the communication port of the ink chamber, the intermediate ink chamber, and the print head. The bubble existing within the communication path and the air conducted from the meniscus forming member are accumulated by this intermediate ink chamber in order to avoid entering of the bubbles into the print head. Even under such a condition that the bubbles are accumulated in the intermediate ink chamber, since the intermediate ink chamber is highly sealed, the negative pressure at the flow path of the ink can be maintained under better condition. Furthermore, the ink present within the intermediate ink chamber and the communication path can be depleted by the bubble point pressure of the meniscus forming member, so that the ink using efficiency can be increased.

Then, in accordance with the invention as recited in aspect 18, since the capillary vessel member is the porous material, the ink can be held by way of the capillary force and the proper negative pressure can be applied to the recording head.

Also, in accordance with the invention as recited in aspect 19, since the capillary vessel member is the three-dimensionally branched filaments, the ink can be held by way of the capillary force and the proper negative pressure can be applied to the recording head.

Also, in accordance with the invention as recited in aspect 20, since the capillary vessel member is the material spun in the three-dimensional form, the ink can be held by way of the capillary force and the proper negative pressure can be applied to the recording head.

Also, in accordance with the invention as recited in aspect 21, since the capillary vessel member is the bundled fiber material, the ink can be held by way of the capillary force and the proper negative pressure can be applied to the recording head.

According to the present invention as recited in aspect 22, the recording apparatus can be constituted by employing the ink tank as in any one of the preceding aspects 1 to 21. In this recording apparatus, since the ink using efficiency is high, the overall recording apparatus can be made compact and at low cost, and further the running cost thereof can be reduced because of the compact ink tank.

DETAILED DESCRIPTION OF THE PREFERRED EMBODIMENTS

Figure 2:
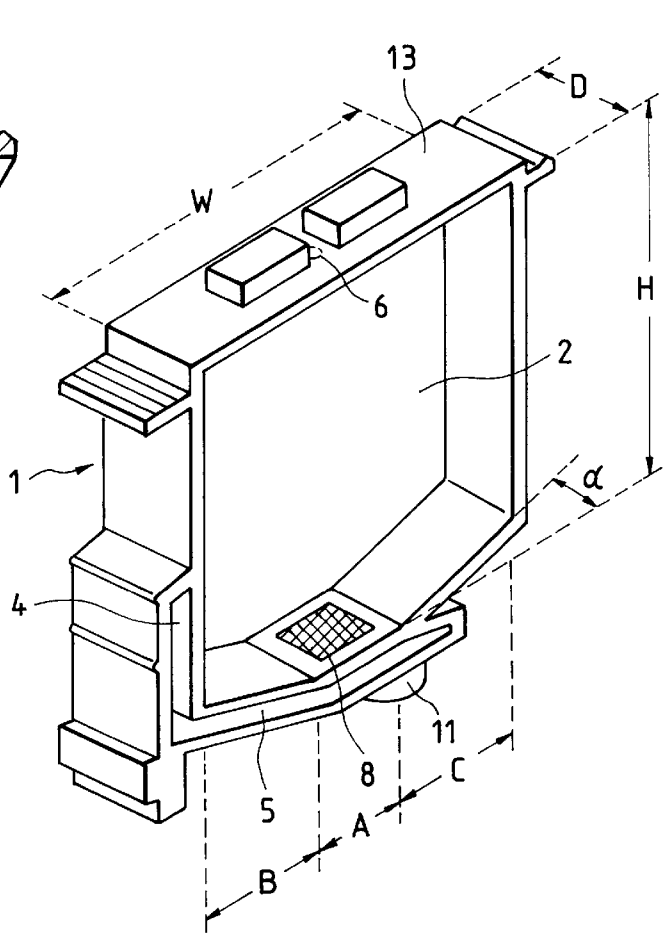
FIG. 2 is a sectional/perspective view for representing an ink tank according to the first embodiment of the present invention.
Figure 1:
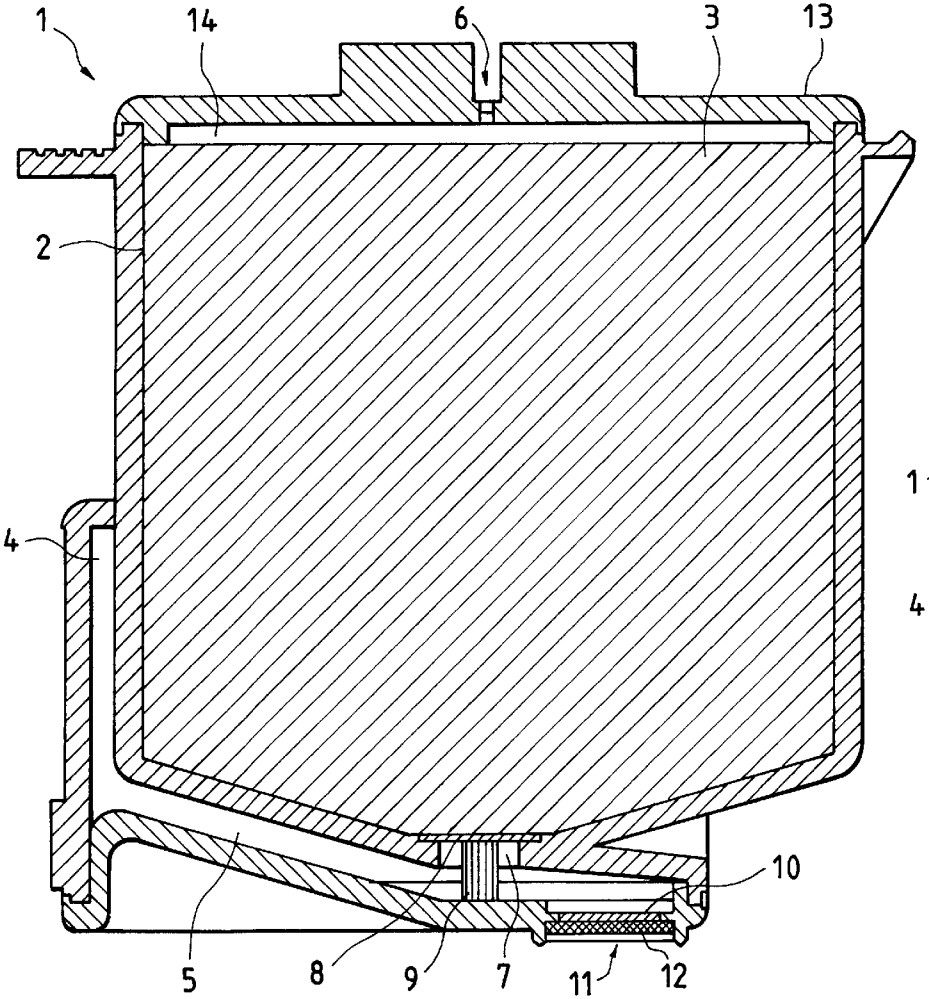
FIG. 1 is a sectional view for representing an ink tank according to a first embodiment of the present invention.
Figure 5:
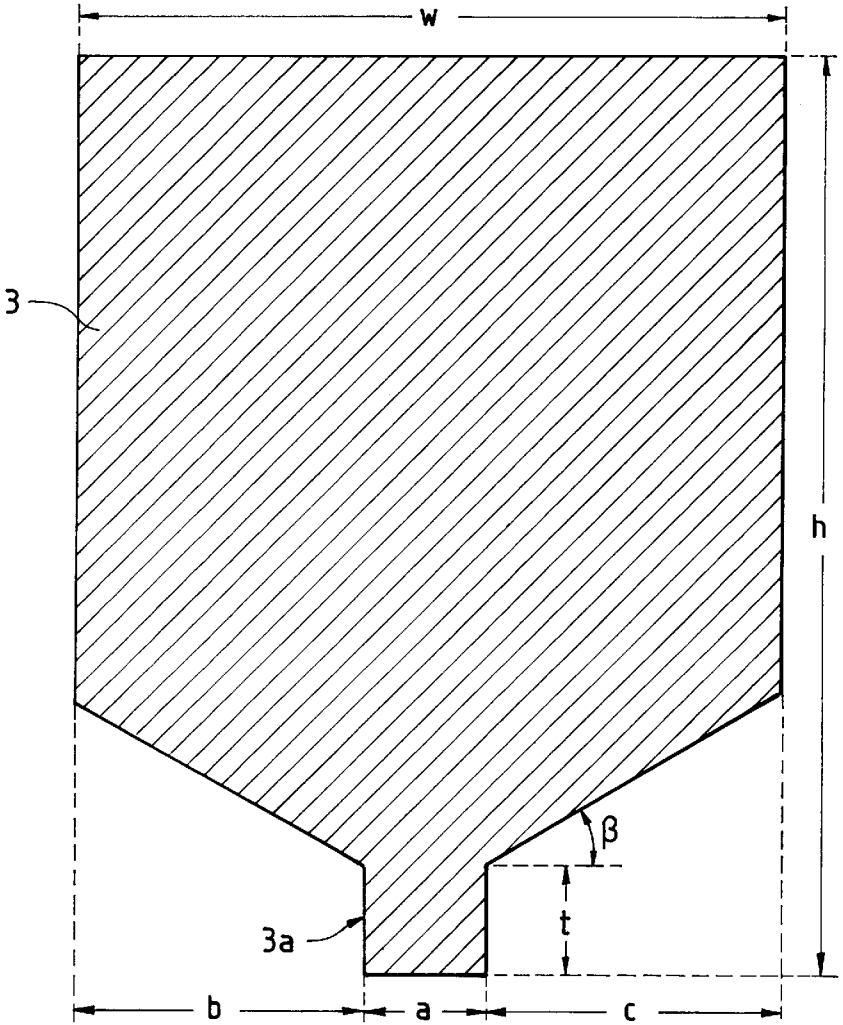
FIG. 5 is a sectional view for representing one example of the shape of the capillary vessel member employed in the ink tank according to the first embodiment of the present invention.
Figure 3:
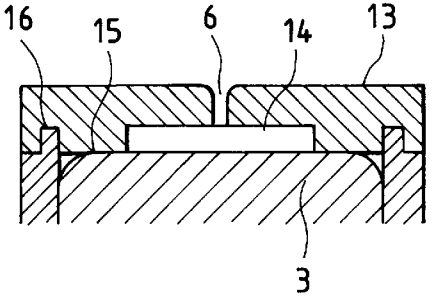
FIG. 3 is an enlarged view for showing another sectional view of the upper unit of the main ink chamber of the ink tank according to the first embodiment of the present embodiment.
Figure 4:
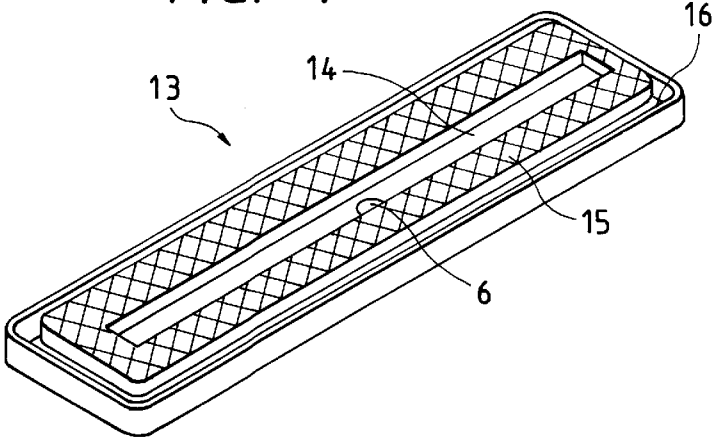
FIG. 4 is a perspective view for indicating one example of the shape of the lid employed in the ink tank according to the first embodiment of the present invention.

FIG. 1 to FIG. 5 are to explain an ink tank according to a first embodiment of the present invention. FIG. 1 is a sectional view of the ink tank. FIG. 2 is a perspective view of the ink tank. FIG. 3 is an enlarged diagram for representing another sectional view of an upper portion of a main ink chamber in the ink tank. FIG. 4 is a perspective view for showing one example of a lid shape. FIG. 5 is a sectional view for showing one shape example of a capillary vessel member. In the drawing, reference number 1 indicates an ink tank, reference number 2 denotes a main ink tank chamber, reference numeral 3 represents a capillary vessel member, reference numeral 4 indicates an intermediate ink chamber, and reference numeral 5 shows a communication path. Reference numeral 6 is an atmospheric communication port, reference numeral 7 shows a communication hole, reference numeral 8 indicates a first meniscus forming member, reference numeral 9 shows an ink supply unit, reference numeral 10 represents a second meniscus forming member, reference numeral 11 is a joint port, reference numeral 12 shows an absorbing member, reference numeral 13 represents a lid, reference numeral 14 denotes a groove, and reference numeral 16 represents a concave portion. In this embodiment, there are shown a print head and a separate type ink tank. FIG. 2 represents the print head and the ink tank except for a front side wall and the capillary vessel member 3. FIG. 3 is such a sectional view along the direction perpendicular to the sectional view of FIG. 1.

Within the ink tank 1, the main ink chamber 2 and the intermediate ink chamber 4 beside this main ink chamber 2 are provided. The housing of the ink tank 1 has stiffness, and such a material having a better ink resistance characteristic in order that the ink can be held for a long time. The upper portion of the main ink chamber of the ink tank 1 is constituted as the lid 13 in a separate form, and is fixed to the main body by way of such a fixing means as ultrasonic melting means. The joint port 11 is provided at the lower portion of the ink tank 1. This joint port 11 is connected to a print head (not shown). The ink within the main ink chamber 2 passes through the communication path 5, and is supplied via this joint port 11 to the print head.

In the lid 13 at the upper portion of the main ink chamber 2, the atmospheric communication port 6 capable of being atmospheric-communicated with the capillary vessel member 3 is defined. In this embodiment, a diameter of the atmospheric communication port 6 is made larger than either the hole of the capillary vessel member 3 or the space between the fibers. The capillary vessel member 3 is communicated at its upper portion with the atmosphere, and is released under atmospheric pressure. When the ink is supplied to the ink head, the ink within the capillary vessel member 3 is depressed by the atmospheric pressure. Also, the ink is drawn from the lower portion of the capillary vessel member 3 to the communication path 5 by the negative pressure, the ink of the capillary vessel member 3 can be effectively used. At this time, the negative pressure in the print head can be kept constant due to the capillary force of the capillary vessel member 3. It is also possible to employ a sheet for causing air to pass therethrough, but the ink not to pass at the atmospheric communication port 6 in order that the ink does not jump from the atmospheric communication port 6. Alternatively, the atmospheric communication port 6 may be constructed by making a large number of very small holes through which no ink can pass.

As indicated in FIG. 4, the surface of the lid 13 located opposite to the capillary vessel member 3 is constructed of a plane portion 15 and a groove 14 extending along the longitudinal direction is formed at a center portion of this plane portion 15. Then the atmospheric communication port 6 is formed in this groove 14. Therefore, as shown in FIG. 3, the capillary vessel member 3 is isolated from the atmospheric communication port 6 by this groove 14. In connection therewith, the air layer is formed at the upper surface of the capillary vessel member 3, and it is so arranged that the air may be spread over the wide range of the upper surface of the capillary vessel member 3. In this portion, since the capillary vessel member 3 is under release condition, the compression degree around this capillary vessel member 3 can be set to be lower than, or equal to the compression degree near the center thereof. The lid 13 is merely made in contact with the capillary vessel member 3 and the plane portion 15, but is not compressed.

As concrete dimensions of the lid 13, for instance, when a depth "D" of the main ink chamber 2 is 13 mm and a width "W" thereof is 48.8 mm, the groove 14 having a width of 6 mm, a length of 46 mm, and a depth of 1.5 mm may be fabricated. At this time, a thickness of the lid 13 in the plane portion 15 is selected to be on the order of 3.5 mm. The atmospheric communication port 6 may be fabricated at the center portion of the groove 14. An inner diameter of the atmospheric communication port 6 may be selected to be 0.7 mm, for example.

Referring back to FIG. 1 and FIG. 2, the capillary vessel member 3 is arranged within the main ink chamber 2. This capillary vessel member 3 holds the ink by way of the capillary force and maintains the negative pressure in the recording head. As the material of the capillary vessel member 3, a fibrous material having a two-dimensional structure, a porous material having a three-dimensional structure, a felt made by spinning a fibrous material in a three-dimensional form and an unwoven material, and a three-dimensionally branched filaments may be used. Concretely speaking, for instance, a fiber bundle made by bundling a polyester fiber may be utilized. As this fiber bundle, for instance, density (=weight/volume) thereof is selected between 5% and 15%. Also, such a polyester felt may be used which is made by spinning a polyester fiber in a three-dimensional form. The density of this polyester felt is properly selected between 0.05 g/cm$^3$ and 0.1 g/cm$^3$. These selected density values are suitable in view of the capillary force and the fluid resistance with respect to the ink. It should be noted that the structure of the material is not limited to the polyester fiber, but other materials which own proper capillary force and ink resistance characteristics such as polypropylene may be used. In this embodiment, a polyester felt whose density is 0.05 g/cm$^3$ (when this polyester felt is mounted within the main ink chamber) is employed.

Also, as the three-dimensional mesh structure, fully open cell polyester polyurethan may be employed. As a preferable concrete example of this full open cell polyester polyurethan, "URTRA FINE (tradename)" may be used as described in Japanese Laid-open Patent Application No. 7-329313.

In FIG. 5, there is shown a shape of this capillary vessel member 3. Reference numeral 3*a* indicates a convex-shaped portion. A bottom surface of this capillary vessel member is made of an inclined surface having an angle of "β°" with respect to such a surface positioned parallel to the upper surface of the capillary vessel member 3. Furthermore, the portion 3*a* positioned in contact with the communication hole formed by the meniscus forming member 8 shown in FIG. 1 and FIG. 2, is made in a convex shape having a height of t mm.

A relationship between an inclined angle "α" of the bottom portion of the main ink chamber 2 shown in FIG. 2 and the angle "β" shown in FIG. 5 becomes $\beta>\alpha$, preferably $\beta-\alpha=15°$. For instance, these angles may be selected as $\alpha=15°$ and $\beta=30°$. The height "t" of the concave-shaped portion 3*a* is preferably selected between 2 mm and 6 mm, for instance t=4 mm. When the capillary vessel member having such a shape is mounted in such a manner that as already explained in FIG. 1 and FIG. 2, this capillary vessel member is in contact with the entire bottom surface within the main ink chamber 2, the convex-shaped portion is compressed by the upper surface of the first meniscus forming member 8, so that in particular, the portion with high density is formed. Also around the communication hole 7, the portion near the communication hole 7 especially becomes high density due to a difference in the inclinations of the inclined surface, so that the density gradation is produced. As a consequence, when the ink is consumed in the recording head, the ink is transported from the edge of the capillary vessel member, where the density is low and the ink holding force is low. Thus, the amount of the finally remaining ink is very small, and the ink can be supplied at a high efficiency.

Furthermore, although the peripheral shape of the capillary vessel member 3 has the same shape of the inside of the main ink chamber 2, the size thereof is slightly larger than that of the main ink chamber 2. When this capillary vessel member 3 is mounted within the main ink chamber 2, the capillary vessel member 3 is more or less compressed by the side wall of the main ink chamber 2. As a consequence, such bubbles which are propagated from the side wall of the main ink chamber 2 to be entered can be suppressed, and thus the transfers of the bubbles to the communication hole 7 can be avoided. Also, the capillary vessel member 3 is made in contact with this side wall under pressure, so that the position of the capillary vessel member 3 is defined by this friction force. As a result, after the capillary vessel member 3 has been mounted into the main ink chamber 2, the position thereof can be maintained without being depressed by the lid 13. As a consequence, the plane portion 15 of the lid 13 is merely made in contact with the capillary vessel member 3, in a certain case. Even when the plane portion 15 is made in contact with the capillary vessel member 3, since the air is fed to the upper surface of the capillary vessel member 3 by the groove 14 under better conditions, the ink reservoired in the contact portion with the plane portion 15 can be reduced.

As to a concrete example of dimensions of the capillary vessel member for the ink tank indicated in FIG. 2, assuming now that a length of a horizontal portion of the first meniscus forming member 8 in the bottom surface of the ink tank is "A"; normal projection distances (horizontal distances) of inclined surface portions provided at both sides are "B" and "C"; a height from the horizontal portion to the lower surface of the lid 13 is "H"; a width in the lower surface of this lid 13 is "W"; and a depth thereof is "D", A=8.5 mm, B=19.4 mm, C=19.4 mm, H=50 mm, W=48.8 mm, and D=13 mm. With respect to a total value of A, B and C is 47.3 mm, since W is equal to 48.8 mm, the inner width dimension of the ink tank is slightly widened along the upper direction. This is because the ink tank can be easily pulled out from the mold when this ink tank is manufactured by way of a synthetic resin injection molding. It should be noted that the angle of the inclined surface portion $\alpha=10°$. As one concrete dimensional example of the capillary vessel member inserted into this ink tank, assuming now that the width of the convex-shaped portion 3*a* shown in FIG. 5 is "a"; normal projection distances (horizontal distances) of the inclined surface portions provided a both sides thereof are "b" and "c"; an entire height from a tip portion of the convex-shaped portion 3*a* is "h"; a height of the convex-shaped portion 3*a* is "t"; a width of an upper portion is "w"; and a thickness thereof is "d", a=13 mm, b=18.5 mm, c=18.5 mm, h=62 mm, t=4 mm, and d=15 mm. Since an angle "β" of the inclined portion is equal to 25°, $\beta-\alpha=15°$. Such a capillary vessel member 3 is inserted into the main ink chamber 2 under pressure, so that the upper surface of the capillary vessel member 3 becomes a height of 50 mm from the horizontal portion near the first meniscus forming member 8. As a result, the upper surface of the capillary vessel member 3 becomes such a height made in contact with the lower surface of the capillary vessel member 3.

Referring back to FIG. 1 and FIG. 2, another explanation will be made. The communication hole 7 is formed in the lower portion of the main ink chamber 2, and is communicated via the communication path 5 to the intermediate ink chamber 4 and the joint port 11. As the sectional shape of the communication hole 7, various shapes may be employed such as circular, ellipsoidal, polygon, star, cross, and slit shapes. The bottom surface of the main ink chamber 2 is formed as such an inclined surface that the communication hole 7 functions as the minimum low portion. This inclined surface is formed having the gradient angle of $\alpha°$ as shown in FIG. 2 with respect to the horizontal plane where the first meniscus forming member 8 is mounted.

The first meniscus forming member 8 is provided in the communication hole 7 formed in the bottom surface of the main ink chamber 2. The bottom portion of the capillary vessel member 3 is arranged on the first meniscus forming member 8 under pressure condition. As the first meniscus forming member 8, for example, a mesh-shaped member such a metal mesh and a resin mesh, and a porous body may be employed. For example, a resin fiber such as Twilled Dutch Weave, and a filter corresponding to a metal woven article, and also such a filter having a very fine hole diameter by the laser beam processing and the electron beam processing may be employed. As the shape of this mesh, it is possible to employ such a shape capable of covering the communication hole 7 as a circular and a rectangular.

When the ink is dipped into the capillary vessel member 3, the ink is penetrated through the first meniscus forming member 8 and transported to the intermediate ink chamber 4. Even when the ink is depleted in the capillary vessel member 3, the first meniscus forming member 8 prevents the unwanted air from being entered into the intermediate ink chamber 4. When the ink is further consumed, the air which has entered from the atmospheric communication port 6 passes through the capillary vessel member 3, and depresses the meniscus of the ink extended over the very small hole formed in the first meniscus forming member 8 in contact with the capillary vessel member 3. Then, this air can pass through this meniscus against surface tension to become bubbles. The produced bubbles pass through the communication path 5 and then is moved to the intermediate ink chamber 4. The pressure when the bubbles are produced (namely bubble point pressure) may depend upon filtering roughness of the first meniscus forming member 8. By properly selecting this filtering roughness, the negative pressure in the ink tank 1, namely the ink supply pressure to the print head can be kept constant. As the filtering roughness of the first meniscus forming member 8, for example, 40 to 70 micrometers may be utilized.

A portion of the first meniscus forming member 8 may be extended up to the bottom surface of the communication path 5 as the ink supply unit 9. This ink supply unit 9 has a smaller sectional dimension than the diameter of the communication hole 7. In the case that the bubbles are reservoired on the lower surface of the first meniscus forming member 8, so that a layer of air would be formed, or if the ink within the main ink chamber 2 is depleted, then the fluid surface of the ink would be lowered from the height of the communication hole 7, this ink supply unit 9 sucks the ink from the bottom portion of the communication path 5, and then supplies the ink to the first meniscus forming member 8. As a consequence, the first meniscus forming member 8 can be continuously maintained under wet condition and the negative pressure can be kept. As a result, the best condition can be maintained until the ink is completely depleted. The shape of the ink supply unit 9 is arbitrarily selected from a slit shape, a cube, a triangular prism, a cylindrical shape, and an ellipsoidal prism.

Alternatively, the ink supply unit 9 may be constituted as a separate member which is directly mounted on the first meniscus forming unit 8 in order to contact with the first meniscus forming member 8. Otherwise, it may be arranged to be fixed by a convex portion from the side wall of the communication hole 7. At this time, the material of the ink supply unit 9 may be not identical to that of the first meniscus forming member 8. Alternatively, any materials may be employed which can supply the ink to the first meniscus forming member 8 by the capillary force. For instance, there are employed a fiber bundle where polyester fabric or polypropylene fabric is bundled along one direction, a porous member such as polyurethane and melamine foam, and a two-dimensional-shaped fabric structural body, and also a three-dimensional-shaped fabric structural body. Fully open cell polyester polyurethan may be employed. As a concrete example, the above-described "URTRA FINE (tradename)" may be employed.

The communication path 5 is communicated with the intermediate ink chamber 4, the main ink chamber 2, and the joint port 11 in this order. Although the upper wall of the communication path 5 is made flat, as illustrated in FIG. 1, this upper wall may be made oblique in such a manner that this upper wall is gradually increased toward the intermediate ink chamber 4. As a result, the bubbles produced in the communication hole 7 may be smoothly moved to the intermediate ink chamber 4. This inclined surface may be made only in the section for connecting the intermediate ink chamber 4 with the main ink chamber 2. Alternatively, the upper surface of another section for connecting the main ink chamber 2 with the joint port 11 may be made oblique, so that the bubbles conducted from the joint port 11 can be smoothly to the intermediate ink chamber. Although the bottom surface of the communication path 5 may be made horizontal, only the section for communicating the intermediate ink chamber 4 with the main ink chamber 2 is formed as the inclined surface in this embodiment. The position of the joint port 11 is not limited to the illustrated position, but may be apparently located close to the intermediate ink chamber 4. Alternatively, the joint port 11 may be opened toward the side direction.

Under initial condition, the intermediate ink chamber 4 is filled with the ink. Then, the bubbles which have passed through the first meniscus forming member from the main ink chamber 2 and have entered into the communication path 5 are accumulated. The dimensions of the intermediate ink chamber 4 may be selected to be such dimensions capable of accumulating the bubbles suddenly entered into the intermediate ink chamber 4 until the ink filled in the main ink chamber 2 is depleted, and therefore may be constituted by a small chamber. To accumulate the bubbles, under such a condition that this ink tank 1 is mounted on a recording apparatus (not shown), the upper surface of the intermediate ink chamber 4 is located higher than the communication hole 7 of the main ink chamber 2.

The second meniscus forming member 10 and the absorbing member 12 are provided in the joint port 11 in this order. Under such a state that the ink tank 1 is removed and, released, there is no risk that the ink present within the intermediate ink chamber 4 and the communication path 5 are not overflown from the joint port 11 by surface tension of the ink produced in the very small hole formed in this second meniscus forming member 10. Also, the air which will remain at the joint port 11 by the pressure exerted when the ink tank 1 is mounted on the recording apparatus is penetrated through the ink film of the second meniscus forming member 10, and is transported to the intermediate ink chamber 4. As a result, the mixture of the bubbles into the print head can be reduced. Furthermore, under such a condition that the ink tank 1 is mounted, it is possible to avoid the vibrations and shock applied to the ink tank 1, the pressure variations caused by the acceleration speed, and the bubble mixtures of the print head from the nozzle side. As the material of the second meniscus forming member 10, such an SUS mesh whose meniscus open diameter becomes 10 to 50 micrometers may be employed, a narrow line of SUS is made in a felt form, or such a filter that the narrow lines are compressed and sintered to form a base member may be employed. The meniscus open diameter is determined based up the characteristics of the capillary vessel member 3 and also of the ink, and the sizes of the ink tank 1. This meniscus open diameter is so designed that the ink is not leaked under such a condition that the ink tank 1 is removed, and the air is not entered even when the ink tank 1 is reversed.

Also, the absorbing member 12 provided at the joint port 11 can prevent the ink attached to the joint port 11 from being dropped out when the ink tank 1 is mounted/released. A material having better ink absorbing force is utilized as the absorbing material 12. The absorbing member 12 may be constituted by a sponge, by bundling polyester fabric or polypropylene fabric, by a polyester felt. A low flow path resistance of this absorbing material 12 may be desired.

Figure 6:
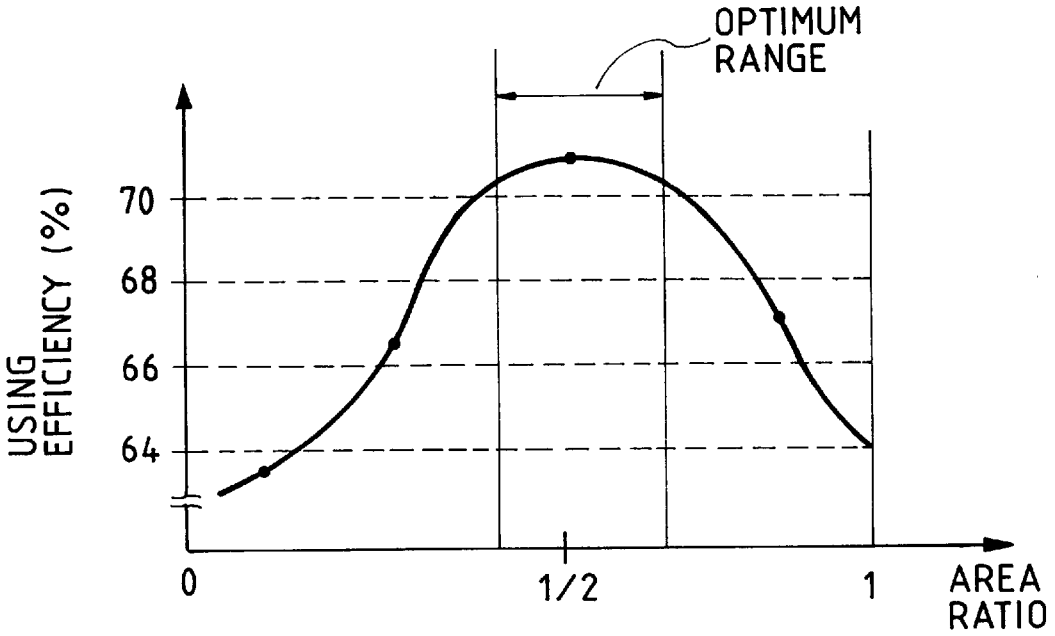
FIG. 6 is a graphic representation for showing a relationship between a ratio of a contact area of the lid to that of the capillary vessel member, and the using efficiency of the ink.

A further consideration will now be made of the above-explained lid 13. FIG. 6 is a graphic representation for showing such a representation between a ratio of the cross-section area of the capillary vessel member to the contact area between the lid and the capillary vessel member, and the use efficiency of the ink. FIG. 7 is an explanatory diagram about a relationship between the cross-section area of the capillary vessel member and the contact area between the lid and the capillary vessel member. Assuming now that the cross-section area of the capillary vessel member is constant, FIG. 6 may represent such a relationship between the contact area between the lid 13 and the capillary vessel member 3, namely a relationship between the area of the lid 13 for the plane portion 15, and the ink use efficiency. As indicated in FIG. 6, when the area of the plane portion 15 becomes approximately ½, the use efficiency of the ink becomes maximum. When this area of the plane portion 15 is further increased, or decreased, the use efficiency of the ink would be lowered.

Figure 7A:
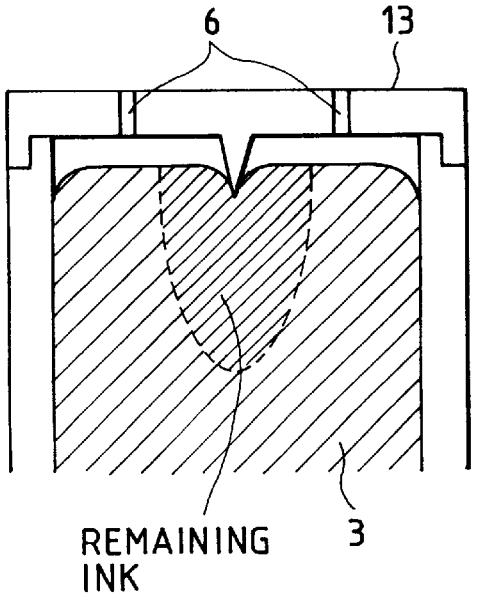
FIGS. 7A and 7B are explanatory diagrams for explaining the relationship between the sectional area of the capillary vessel member, and the contact areas of the lid and the capillary vessel member.
Figure 7B:
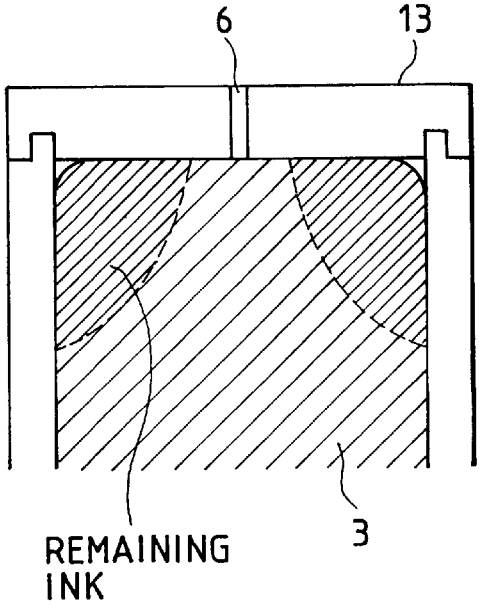

Considering now such a case that the area of the plane portion 15 is small, as indicated in FIG. 7A, it is approximated to such a point contact as employed in the conventional ink tank. As a result, it is conceivable that the ink would easily remain at the contact portion between the plane portion 15 and the capillary vessel member 3, and therefore the ink using efficiency would the lowered. Conversely, considering now another case that the area of the plane portion 15 is large, as shown in FIG. 7B, air could not readily enter into a space between the capillary vessel member 3 and the plane portion 15. Thus, it is conceivable that the ink would also remain at the contact portion, and thus the ink using efficiency would be lowered. As described above, in the case that the area of the plane portion 15 becomes excessively larger, or smaller than the cross section of the capillary vessel member 3, the ink using efficiency would be lowered. As a result, when the area of the plane portion 15 is made approximately a half of the cross section of the capillary vessel member 3, the ink can be effectively used.

Figure 8A:
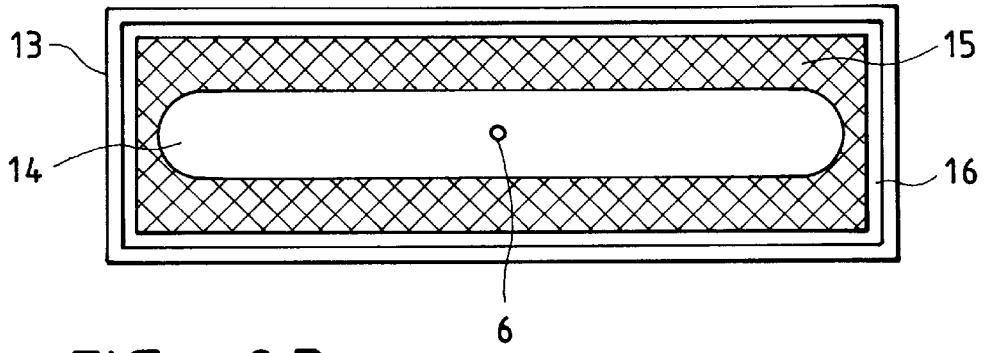
FIGS. 8A and 8B are plan views of showing another example of the lid 13.

FIG. 8 is a plan view for showing another example of the lid 13. As the shape of the groove 14 formed in the lid 13, there are various shapes other than a rectangular groove as indicated in FIG. 4. For example, as shown in FIG. 8A, the shape of the edge portion of the groove 14 may be made of either arc or elliptical. Alternatively, this shape may be made of, for example, such shapes having a cross-shaped portion, a partially widened portion, and a partially narrowed portion. At this time, when the groove is formed in such a manner that this groove is extended along the longitudinal direction, the ink remaining near the edge portion of the capillary vessel member 3 could be reduced, as compared with such a groove that a wide space is formed at a center portion thereof.

Figure 8B:
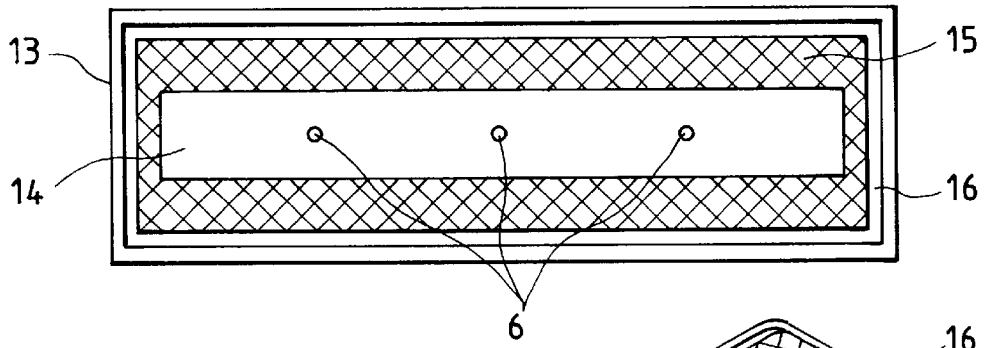

Also, the present invention is not limited to the number of atmospheric communication port 6 formed in the lid 13, i.e., 1. For example, as shown in FIG. 8B, a plurality of atmospheric communication ports 6 may be provided. When such plural atmospheric communication ports 6 are formed, the air can be sufficiently spread within the groove 14, and thus the air can be effectively penetrated into the capillary vessel member 3. When a plurality of atmospheric communication ports 6 are provided, the groove 14 may be subdivided into a plurality of subdivided groove portions. It should be understood that the atmospheric communication ports 6 may be positioned at not only the center portion of the groove 14, but also the edge portion of the groove 14.

Figure 10:
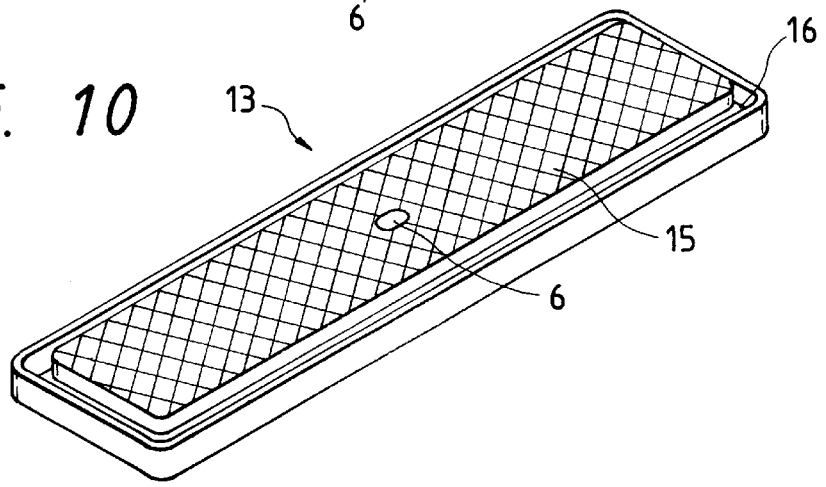
FIG. 10 is a perspective view for representing one example of the shape of the lid employed in the ink tank according to the second embodiment of the present invention.

FIG. 9 and FIG. 10 are explanatory diagrams for explaining an ink tank according to a second embodiment of the present invention. FIG. 9 is a sectional view for representing an example of a shape of a capillary vessel member, and FIG. 10 is a perspective view for indicating one example of a shape of a lid. As will be discussed later, according to the second embodiment, the portion of the lid is different from that of the first embodiment at the main body portion except for the capillary vessel member of the ink tank. However, since other portions are the same as those of FIG. 1 and FIG. 2, the explanations thereof are omitted.

Figure 9B:
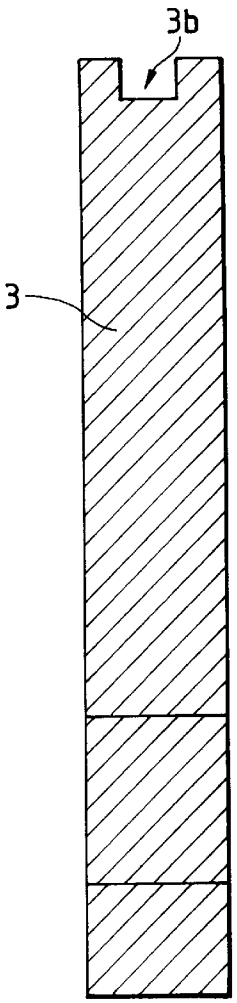
FIGS. 9A and 9B are perspective views for indicating one example of the shape of the capillary vessel member in the ink tank according to a second embodiment of the present invention.
Figure 9A:
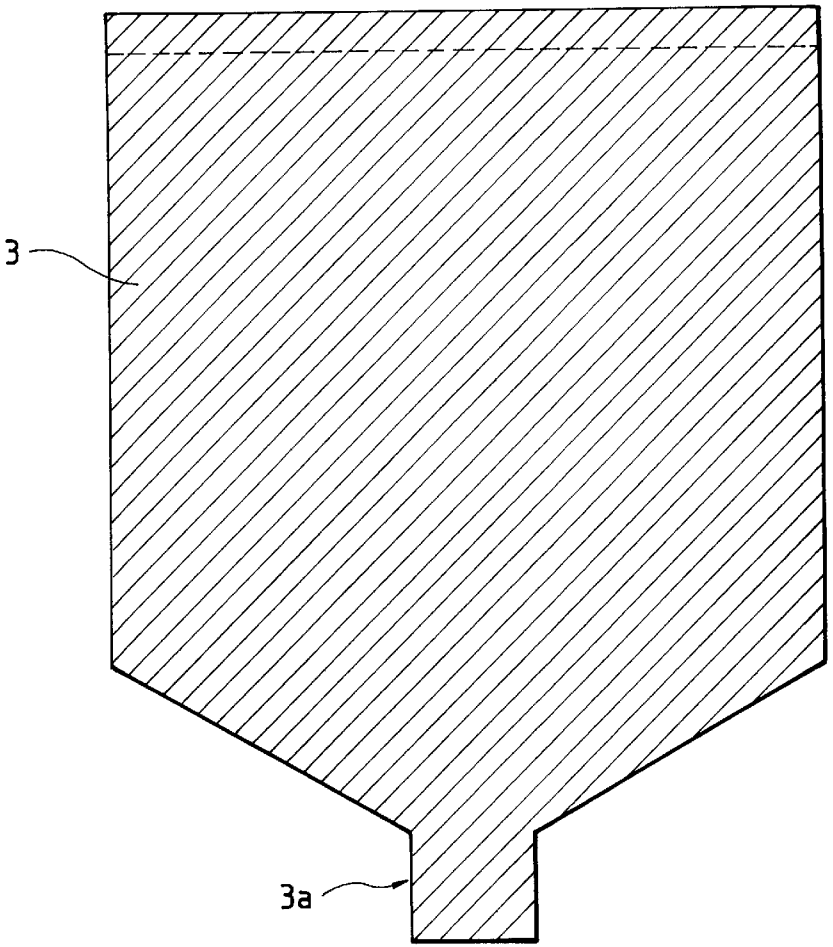

A first description will now be made of the capillary vessel member. FIG. 9A is a sectional view of the same surface of this capillary vessel member as that of FIG. 5. FIG. 9B is a cross-sectional view of the central portion of this capillary vessel member shown in FIG. 9A. In the drawings, reference numeral 3 shows a capillary vessel member, and reference numeral 3*b* is a groove. Although the size and the shape of this capillary vessel member 3 may be made identical to those as explained in FIG. 5, the capillary vessel member 3 according to this second embodiment has such a different point that the groove 3*b* is fabricated in the upper surface thereof in contact with the lid. As will be explained later, the groove 3*b* is formed in such a manner that this groove 3*b* is directed to the transverse direction of FIG. 9A so as not to be in contact with the atmospheric communication hole formed in the lid of the ink. As a result, such a groove 14 as explained in FIG. 3 and FIG. 4 is no longer required in the lid of the ink tank. As one dimensional example of the groove 3*b*, a width of a section is 6 mm and a depth is 3 mm with respect to the dimensions explained in FIG. 5. It should be noted that although the sectional shape of this groove is a rectangular shape, this sectional shape is not limited thereto, but other shapes such as a triangle and a semicircle may be employed.

FIG. 10 is a perspective view for showing a lid suitably used in an ink tank where this capillary vessel member is employed. The same reference numerals shown in FIG. 4 will be employed as those for denoting the same or similar portions indicated in FIG. 10, and explanations thereof are omitted. Similar to FIG. 4, a hatched portion is employed so as to clearly illustrate a surface in contact with the capillary vessel member. As apparent from the drawing, no longer such a groove 14 as explained in FIG. 4, and therefore there is such a merit that the structure of the lid can be made simple. To the contrary, as previously explained in FIG. 4, there is no problem to employ a lid with the groove. The number of the atmospheric communication hole 6 is not limited to 1, but may more than 1.

Figure 11:
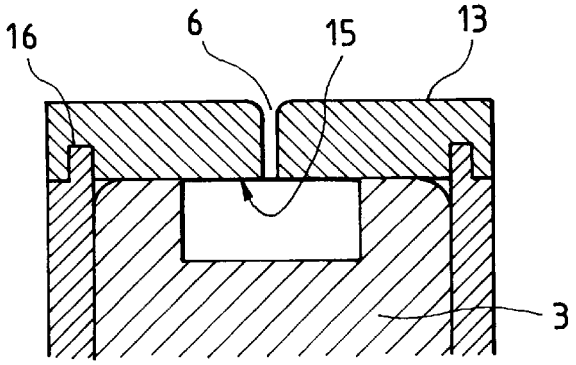
FIG. 11 is a sectional view for showing the ink tank with employment of the capillary vessel member according to the second embodiment of the present invention.

FIG. 11 is a sectional view for showing an ink tank where this capillary vessel member is employed. The same reference numerals shown in FIG. 3 will be employed as those for denoting the same or similar portions indicated in FIG. 11, and explanations thereof are omitted. Since the atmospheric communication port 6 formed in the lid 13 is located opposite to the groove 3*b* of the capillary vessel member 3, the capillary vessel member 3 is not directly in contact with the atmospheric communication port 6, but also the capillary vessel member 3 is not compressed by the surface having the atmospheric communication port 6. As a consequence, it is possible to properly supply the air to the capillary vessel member provided inside the main ink chamber without unnecessarily increasing the capillary force at the portions other than the ink supply port.

FIG. 12 to FIG. 16 are explanatory diagrams for explaining one example of operations of the ink tank according to the first embodiment of the present invention, which are similar to the ink tank according to the second embodiment. In the respective drawings, the print head portion connected to the joint port is omitted. FIG. 12A to FIG. 16A represent remaining amounts of the ink, whereas FIG. 12B to FIG. 16B show graphic representations for indicating static (hydrostatic) pressure of the ink and dynamic pressure of the ink. The static pressure of the ink implies such pressure when no printing operation is carried out. This static pressure is produced from the pressure caused by the capillary force of either the absorption member or the meniscus forming unit, and the head pressure from the fluid surface of the ink. Also, the dynamic pressure of the ink is conceivable as a summation a loss in pressure produced by a flow rate of the ink and a fluid resistance in a flow path system, and the static pressure of the ink. The ink dynamic pressure in the respective figures is measured during the set-solid printing operation.

Figure 12A:
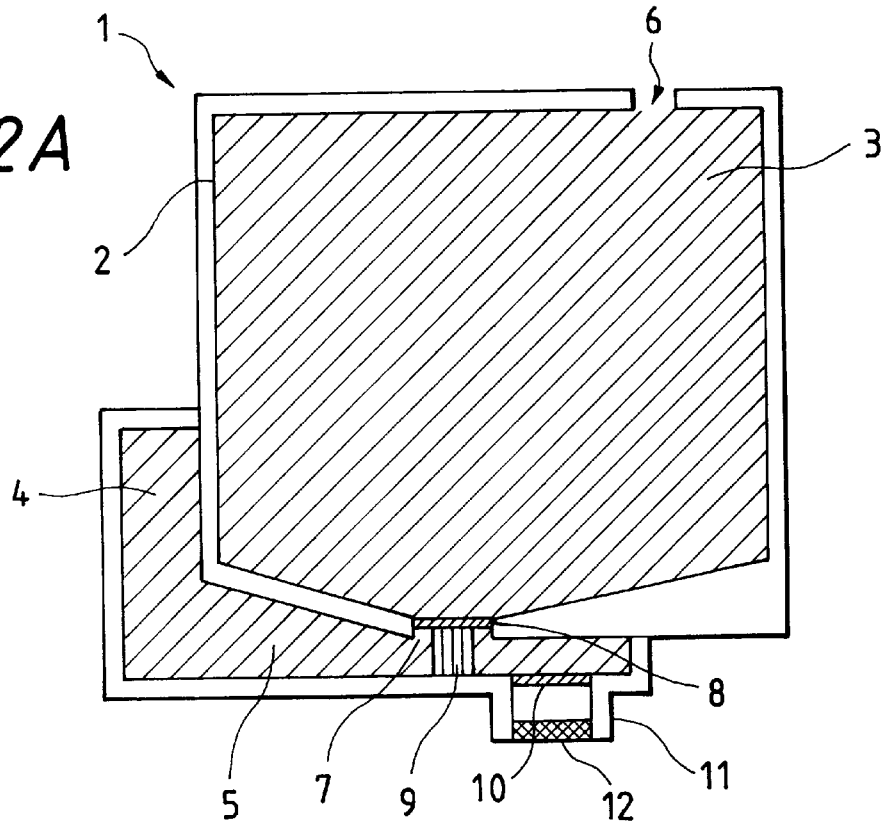
FIGS. 12A and 12B are explanatory diagrams for explaining an initial condition of the operations of the ink tank according to the first embodiment of the present invention.
Figure 12B:
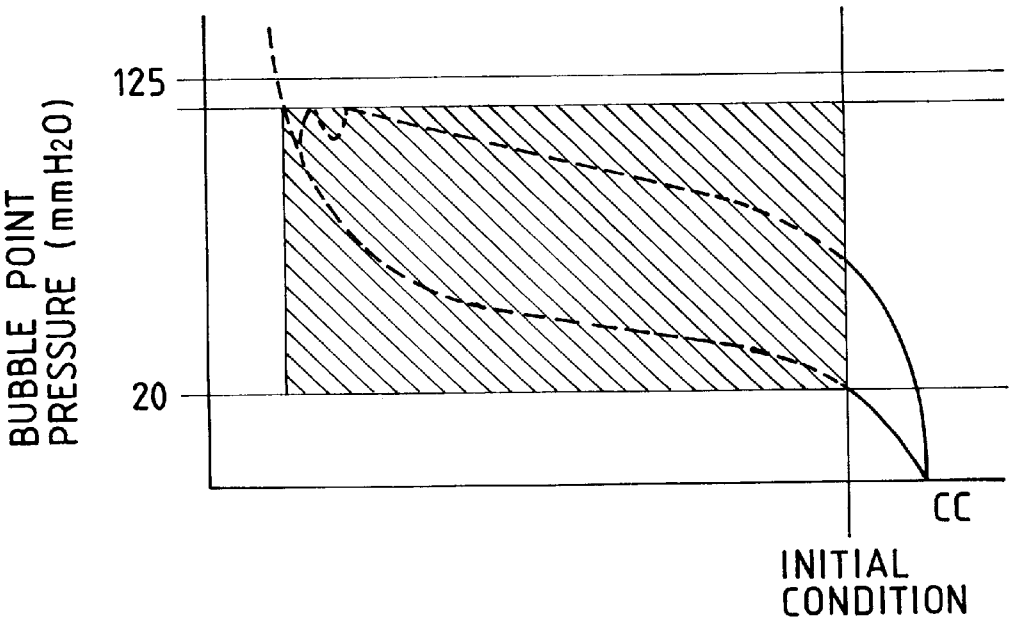

FIG. 12A represents an initial condition when the ink tank shown in FIG. 1 is filled with the ink. Under this initial condition, the ink is filled into the main ink chamber 2 up to such a limit held by the capillary force exerted by the capillary vessel member 3. In view of the ink using efficiency, the main ink chamber 2 is filled with the ink as much as possible as the starting condition. However, in order to produce the negative pressure by the capillary vessel force of the capillary vessel member 3, the ink unfilled portion is required in the capillary vessel member 3 to some extent. Also, the intermediate ink chamber 4 is filled with the ink. In the following description, the initial condition of the ink pressure in the print head is set to, for instance, −20 mm $H_2O$. Under such an initial condition before the ink tank is mounted, this ink pressure can be realized by way of the capillary force of the capillary vessel member 3 so as to hold the ink. The pressure of the ink existing in the intermediate ink chamber 4 and the communication path 5 becomes also negative pressure, and this negative pressure can be maintained by the boundary of the ink formed in the very small holes of the second meniscus forming member 10. Before using the ink tank, both the joint port 11 and the atmospheric communication port 6 may be attached with air tight seals. Under this condition, the ink tank 1 is packaged. When the ink tank 1 is used, these air tight seals are removed and thereafter the ink tank 1 have no air tight seals is mounted on the recording apparatus. The static pressure and the dynamic pressure of the ink just after this ink tank is mounted are indicated in FIG. 12B.

When the ink tank 1 is mounted, there are some possibilities that more or less air will be left in the joint port 11. The remaining air will depress the boundary of the ink formed in the second meniscus forming member 10 by the pressure caused when the ink tank is mounted, and then is penetrated into the communication path 5 as bubbles. The bubbles penetrated into the communication path 5 are moved along the gradient of the upper surface of the communication path 5 by buoyancy of the bubbles themselves, and then are accumulated or integrated into the intermediate ink chamber 4.

Figure 13A:
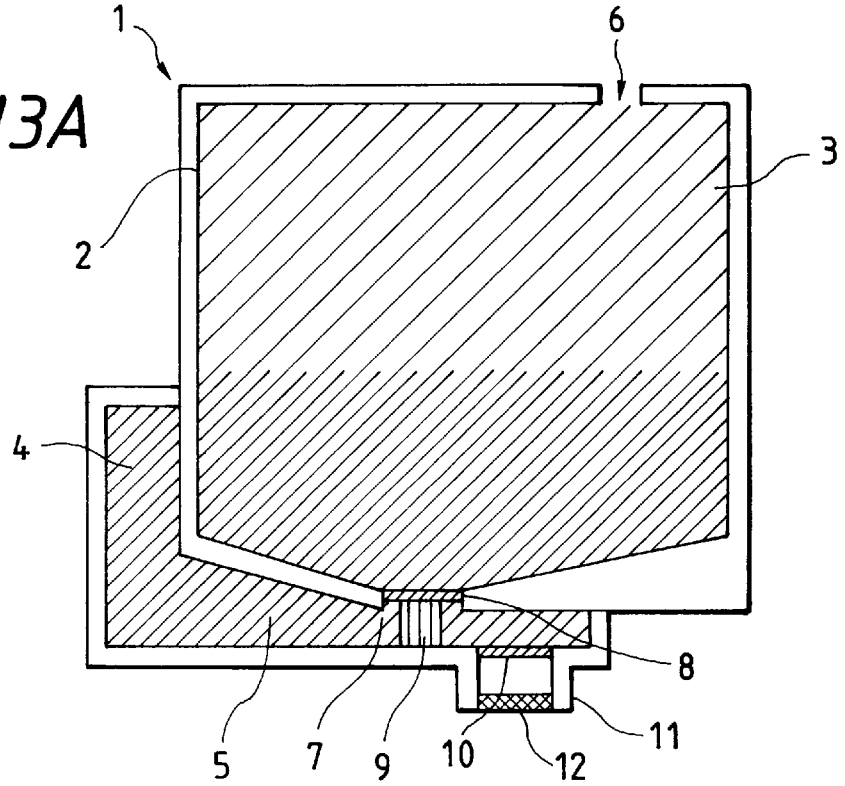
FIGS. 13A and 13B are explanatory diagrams for explaining an intermediate condition of the operations of the ink tank according to the first embodiment of the present invention.

After the ink tank 1 has been mounted, when the printing operation is commenced, the ink is consumed in the print head. Then, as indicated in FIG. 13A, the air is gradually penetrated into the groove 14 from the atmospheric communication port 6 only by the amount of the consumed ink, and further is penetrated into the capillary vessel member 3 to be thereby spread. At this time, since the lid 13 does not depress the capillary vessel member 3, the ink held in the capillary vessel member 3 is moved along the first meniscus forming member 8 under better condition, so that such ink remaining at the contact portion between the lid 13 and the capillary vessel member 3 is reduced.

Figure 13B:
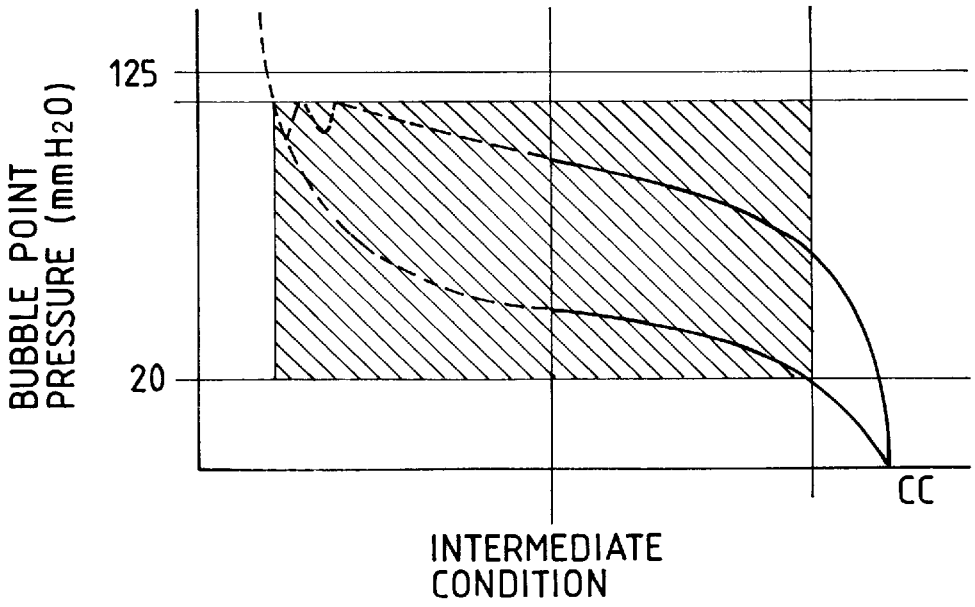

While the amount of ink held in the capillary vessel member 3 is reduced, the head pressure of this ink is lowered, and as indicated in FIG. 13B, the negative pressure is gradually increased but is shifted within the allowable range. Even when the amount of ink becomes small, the ink can be supplied under the stable negative pressure by way of the capillary force of the capillary vessel member 3. The ink held by the capillary vessel member 3 is smoothly moved through the first meniscus forming member 8) to the communication path 5.

While the ink is supplied during the normal printing operation, the air entered from the atmospheric communication port 6 is penetrated through the wall surface of the main ink chamber 2 into the first meniscus forming member 8. Only very small amount of air could reach the side surface and the bottom surface of the main ink chamber 2 due to pressure contact with the capillary vessel member 3 in the side surface and the bottom surface of the main ink chamber 2. Even if a very small amount of air has reached the surface of the fir:st meniscus forming member 8, while the air remains trapped on the first meniscus forming member 8, the ink is continued to be moved. In another case that the bubbles mixed in the ink pass through the capillary vessel member 3, and then the air is in contact with the upper surface of the first meniscus forming member 8, the air can be trapped on the first meniscus forming member 8 by setting the filtering grain size of the first meniscus forming member 8 to be made smaller than that of the capillary vessel member 3, so that the ink is continued to be moved. The ink is transported from the main ink chamber 2 to the intermediate ink chamber 4 until the ink held in the capillary vessel member 3 is substantially completely depleted.

Under such a condition that the bubbles are trapped on the surface of the first meniscus forming member 8, the ink is absorbed from the nozzle tip portion as the maintenance operation in order to avoid the nozzle plugging by the ink. In this case, since the ink is forcibly absorbed from the nozzle tip portion, higher negative pressure than the negative pressure under normal condition will be produced. Also, when a large amount of ink is consumed during the set-solid printing operation, such higher negative pressure than the negative pressure under normal condition will be produced. There are few cases that the bubbles trapped on the surface of the first meniscus forming member 8 are captured from the very fine holes into the communication path 5 together with the ink. The bubbles captured into the communication path 5 of the first meniscus forming member 8 are propagated onto the inclined upper surface of the communication path 5 into the intermediate ink chamber 4 due to the buoyancy of the bubbles themselves. Then, these bubbles are accumulated in the upper portion of the intermediate ink chamber 4. Even when the surface on the side of the communication path 5 of the first meniscus forming member 8 is covered with the bubbles, the negative pressure is maintained by the surface tension owned by the boundary surface of the ink formed in the very fine holes of the first meniscus forming member 8.

Figure 14A:
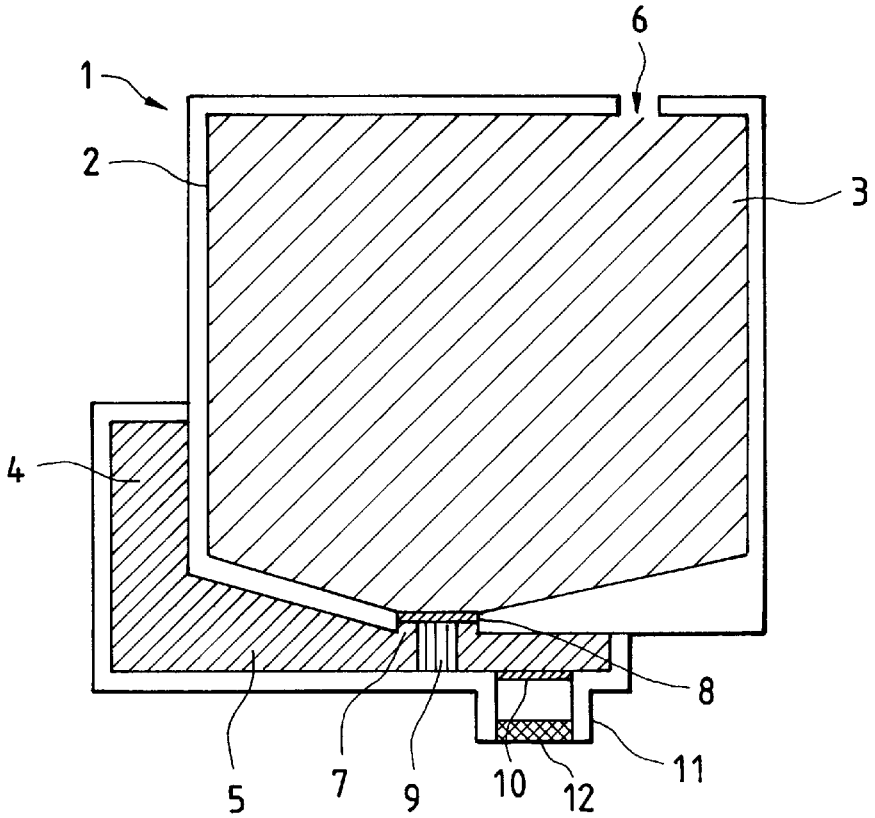
FIGS. 14A and 14B are explanatory diagrams for explaining an ink ending condition in the main ink chamber of the operations of the ink tank according to the first embodiment of the present invention.
Figure 14B:
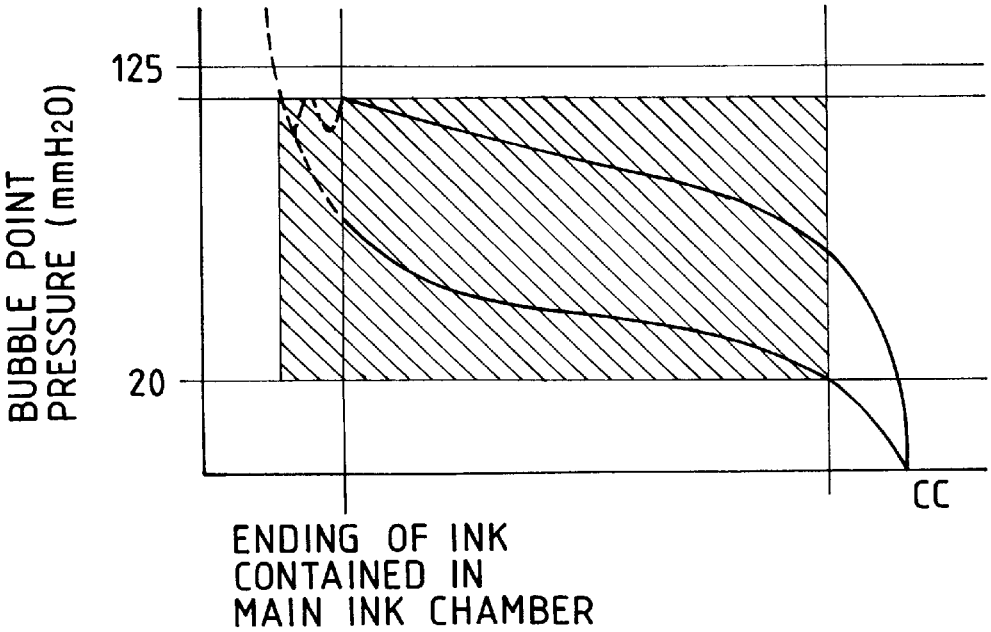
Figure 15A:
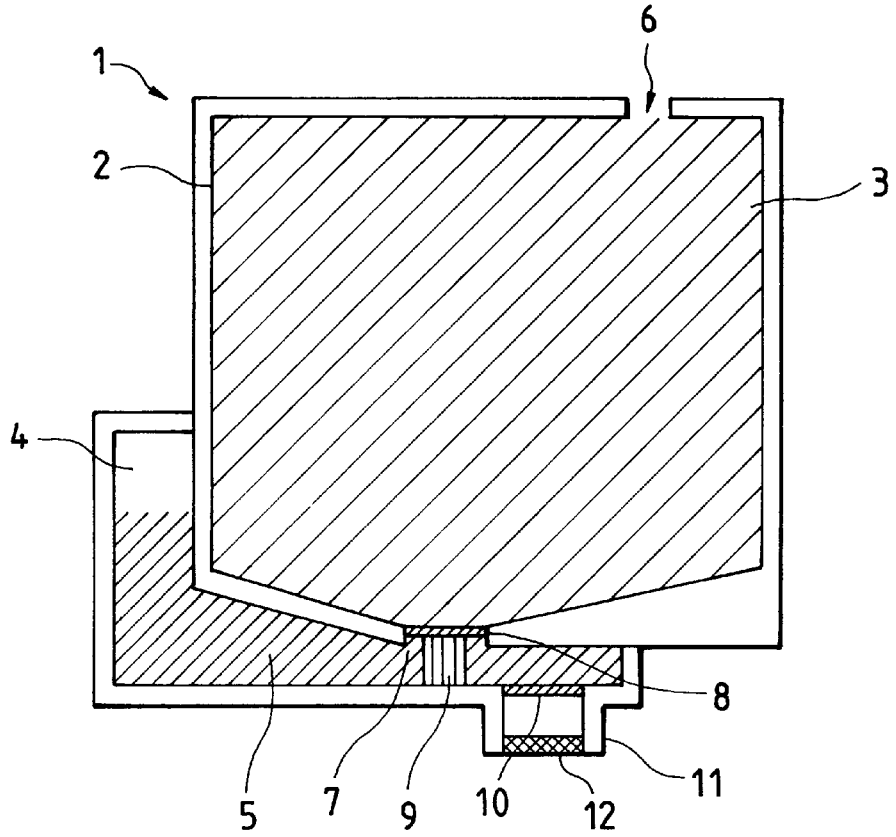
FIGS. 15A and 15B are explanatory diagrams for indicating such a condition that the bubbles are accumulated in the intermediate ink chamber of the ink tank in the ink tank operations according to the first embodiment of the present invention.
Figure 15B:
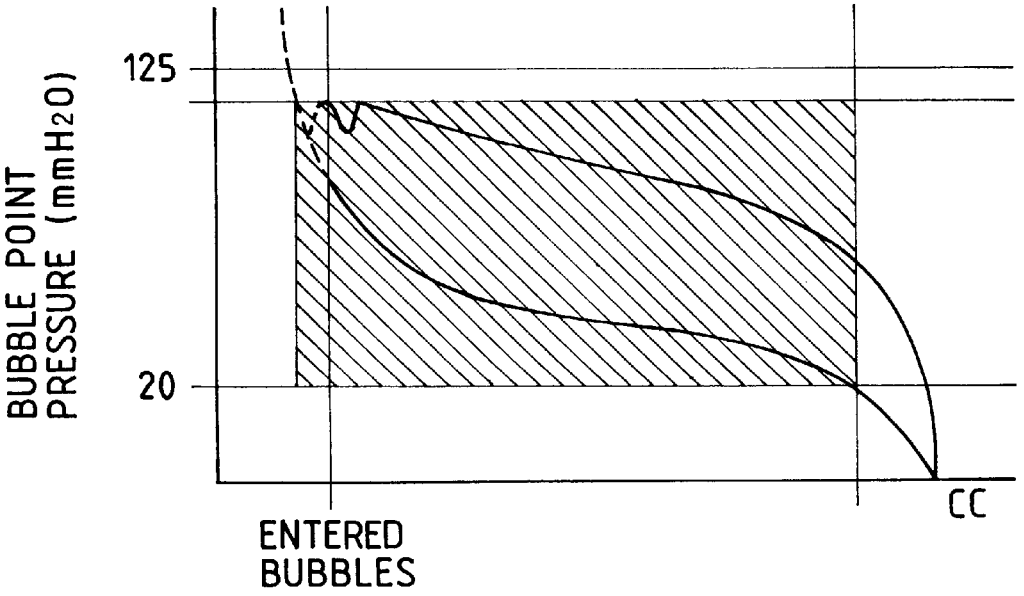
Figure 16A:
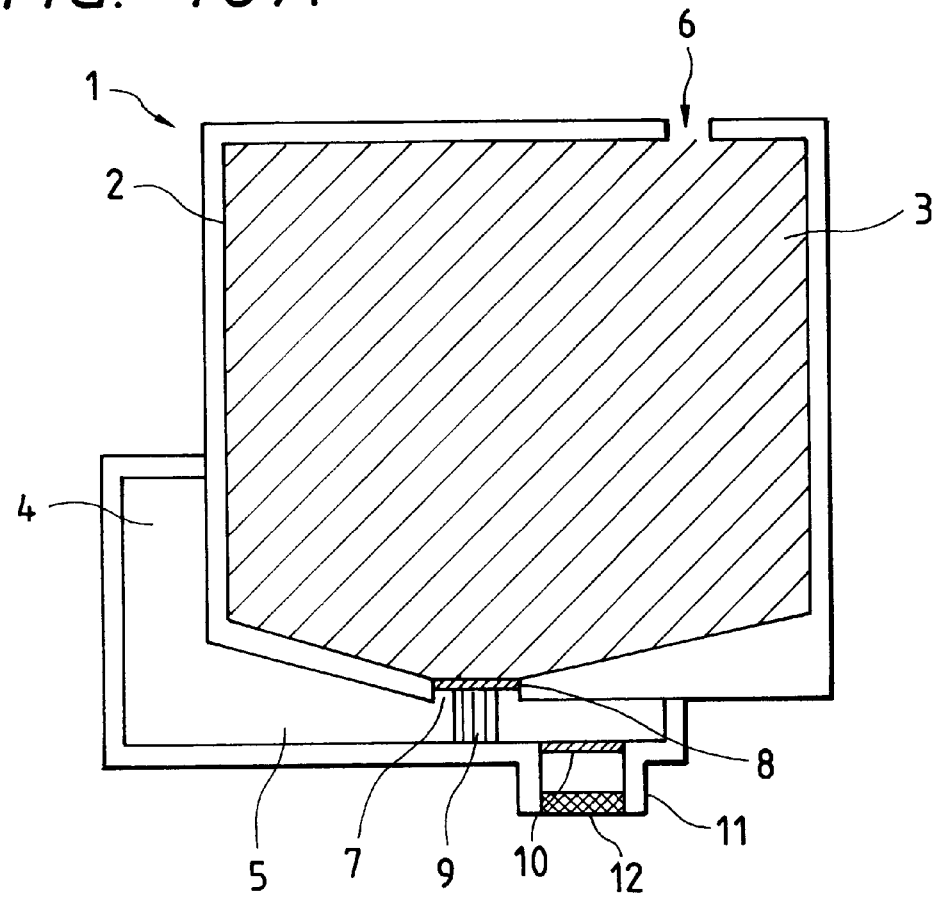
FIGS. 16A and 16B are explanatory diagrams for showing an empty condition of the ink tank according to the first embodiment of the present invention.
Figure 16B:
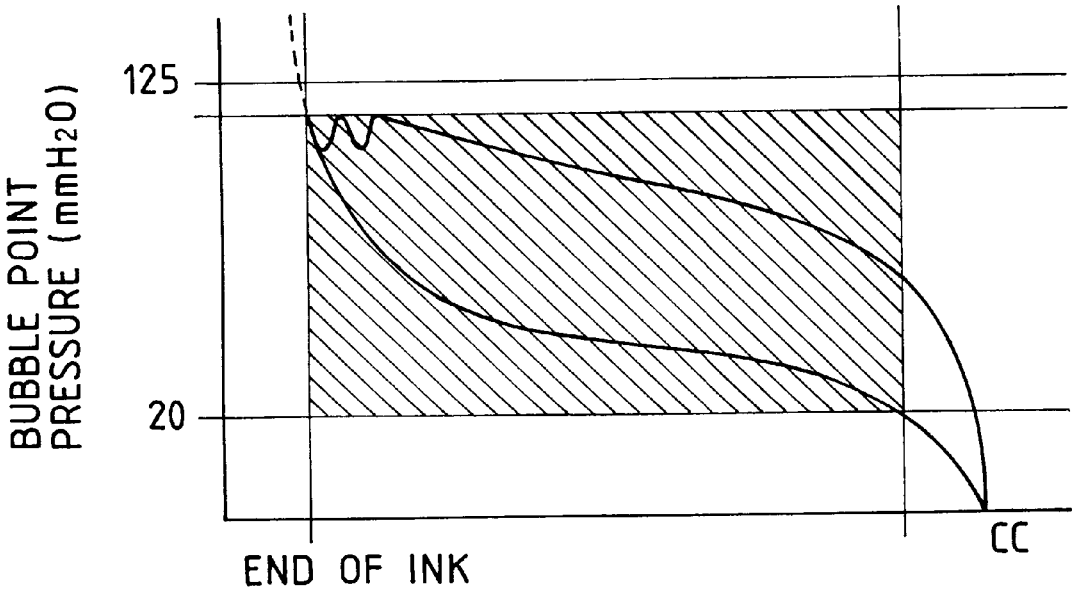

When the ink held in the capillary vessel member 3 is substantially completely depleted, it is brought into such a condition that the air is in contact with the first meniscus forming member 8. This condition is indicated in FIG. 14. Under this condition, either the boundary surface of the ink or the meniscus of the ink is formed in the very fine holes of the first meniscus forming member 8. While the ink is further consumed, when the negative pressure is gradually increased and then a certain constant negative value (namely, bubble point pressure of ink determined by filtering grain size of first meniscus forming member 8) is applied to the first meniscus forming member 8, fine air bubbles are produced on the side of the communication path 5 of the first meniscus forming member 8 through either the boundary surface of the ink or the meniscus formed on the first meniscus forming member 8. The produced fine bubbles are propagated into the inclined surface of the communication path 5 due to the buoyancy of the bubbles themselves, and thereafter are transported into the intermediate ink chamber 4. At this time, since the upper surface of the communication path 5 is inclined, the bubbles can be smoothly transported into the intermediate ink chamber 4. The bubbles which have moved into the intermediate chamber 4 are gradually reservoired into the intermediate ink chamber 4. This condition is shown in FIG. 15. Since the dynamic pressure of the ink after this ink reservoiring is controlled by the first meniscus forming member 8, this dynamic pressure can be maintained at substantially constant until the ink is depleted.

Subsequent to the condition shown in FIG. 15, both surfaces of the first meniscus forming member 8 are exposed by the air. That is, the ink within the main ink chamber 2 is depleted, so that the side of the main ink chamber 2 of the first meniscus forming member 8 is exposed to the air conducted from the atmospheric communication port 6. Similarly, a very small air layer is formed by the bubbles entered vial the first meniscus forming member 8, so that the side of the communication path 5 of the first meniscus forming member 8 is exposed to the air. However, the ink present in the communication path 5 is sucked into the first meniscus forming member 8 by the ink supply unit 9, so that the first meniscus forming member 8 is continuously under wet state. As a consequence, the ink film is continuously formed in the first meniscus forming member 8, and the negative pressure produced after the bubbles are produced can be effectively controlled.

In such a case that the bubbles are conducted to the communication path 5 of the first meniscus forming member 8 irrelevant to such a fact whether of not the ink is present in the main tank chamber 2, as previously explained, the bubbles are propagated onto the inclined upper surface of the communication path 5, and transported to the intermediate ink chamber 4. The bubble transport direction at this time corresponds to such a direction from the communication hole 7 to the intermediate ink chamber 4, whereas the transport direction of the ink supplied to the print head corresponds to the direction from the communication port 7 to the joint hole 11. As described above, the bubble transport direction is directed opposite to the ink transport direction, the ink can be firmly separated from the bubbles, so that the amounts of the bubbles mixed into the print head can be reduced.

When the bubbles are conducted from the condition shown in FIG. 14 into another condition indicated in FIG. 15, since the capacity of the intermediate ink chamber 4 is very small, the fluid surface of the intermediate ink chamber 4 is rapidly lowered. Since at least a portion of the intermediate ink chamber 4 is made of a transparent member, it is possible to detect such a condition that the ink stored in the intermediate ink chamber 4 is substantially completely depleted. In other words, while the ink is present in the main ink chamber 2, the intermediate ink chamber 4 is filled with the ink, or a very small amount of air is present therein. This condition is continued until the ink stored in the main ink chamber 2 is depleted, and this condition of the ink tank 1 is continued during substantially entire periods. However, when the ink stored in the main ink chamber 2 is depleted, the amount of the ink stored in the intermediate ink chamber 4 is rapidly lowered, it is possible that the ink is depleted. Various detecting methods may be employed, for instance, visual detecting methods, and optical detecting methods. Then, as indicated in FIG. 16, the ink supply pressure can be controlled under stable value until the ink present in the intermediate ink chamber 4 and the communication path 5 is substantially constantly depleted.

As previously explained, at least a portion of the intermediate ink chamber 4 is made of a transparent member in order to detect the remaining amount of the ink. Alternatively, the entire portion of the intermediate ink chamber 4, or the overall portion of the ink tank may be made of transparent members. When the entire portions are made by the transparent members, there are such merits that the total number of parts can be reduced, and the sealing characteristic of the intermediate ink chamber 4 may be easily achieved.

It should be noted that even under such a condition that the ink is present in the main ink chamber 2, a small amount of air is accumulated in the intermediate ink chamber 4. For instance, when a check is visually done as to whether or not the ink is present, there is such a risk that although a user visually recognizes a small layer of air and the ink is left in the main ink chamber 2, this user may erroneously believe that no ink is present. To avoid such a problem, for example, a reference line is made at a position where the fluid surface of the intermediate ink chamber 4 does not reach while the ink is left in the main ink chamber 2. Alternatively, the upper portion of the intermediate ink chamber 4 is covered with a blind member, and a window 14 may be formed only in a region where the ink depletion should be detected.

However, when the surrounding environments are changed, for instance, the external atmospheric pressure is varied or the external temperature is changed, since the atmospheric pressure applied from the atmospheric communication port 6 to the capillary vessel member 3 is equal to the atmospheric pressure applied to the tip portion of the nozzle of the print head 1, the balance in the pressure is not changed even if the atmospheric pressure is varied, and therefore there is a very few adverse influence. In the case that the air is integrated in the intermediate ink chamber 4, the integrated air will be expanded or compressed due to the variations in the external atmospheric pressure and the external temperature. When the air within the intermediate ink chamber 4 is compressed, since the negative pressure is increased, this variation is canceled by an operation similar to such an operation when the ink is used. When the air within the intermediate ink chamber 4 is expanded, the ink present in the communication path 5 passes through the first meniscus forming member 8 and is absorbed into the capillary vessel member 3, so that the negative pressure within the communication path 5 can be maintained. However, in any one of these cases, there is a small amount of air existing in the intermediate ink chamber 4. Also, since the capacity of the main ink chamber 2 is considerably larger than that of the intermediate ink chamber 4, there is no specific problem.

Figure 17:
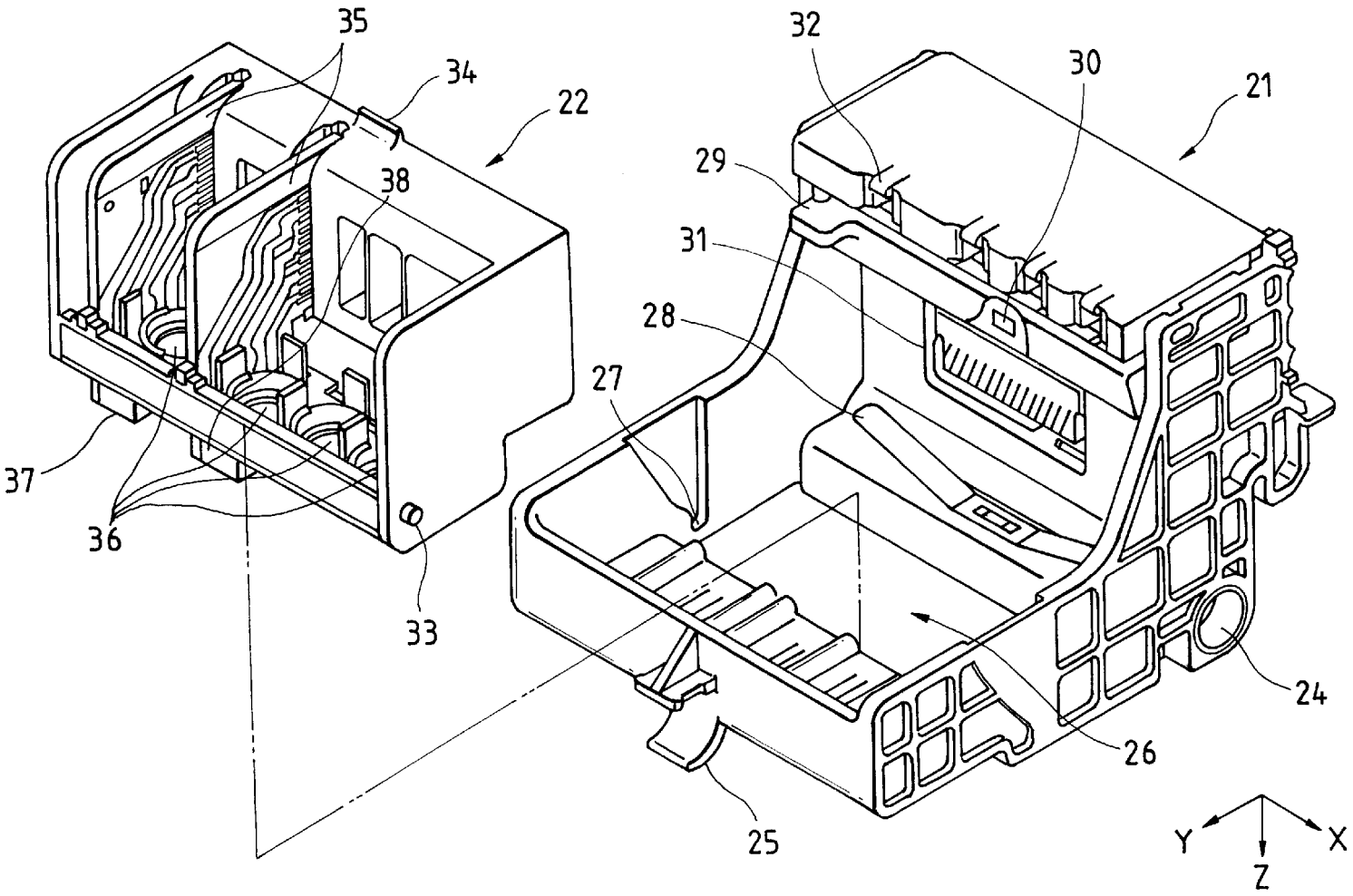
FIG. 17 is a perspective view for indicating a condition of a carriage portion before being mounted on a print head unit in the ink tank according to the first embodiment of the present invention.
Figure 18:
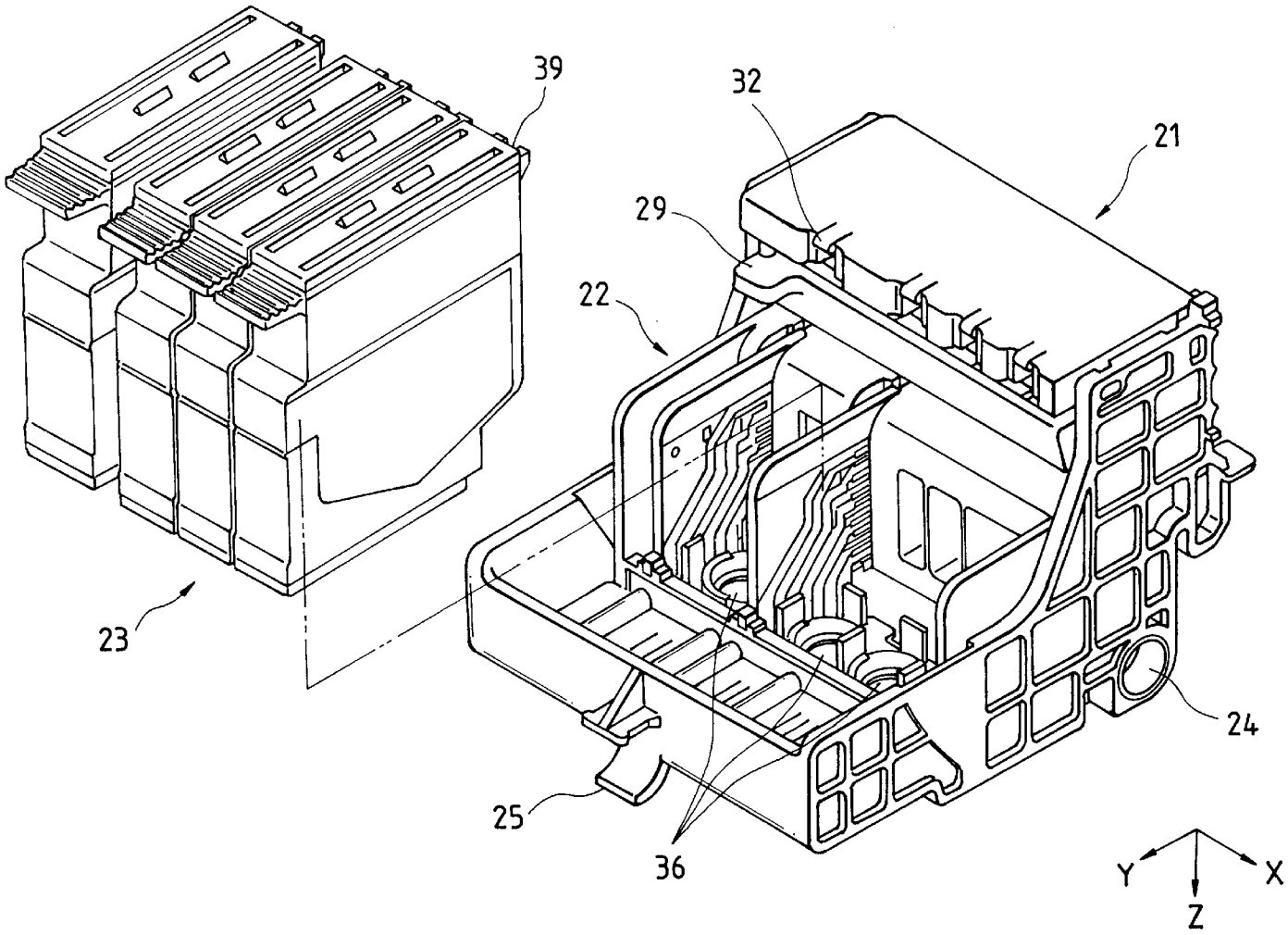
FIG. 18 is a perspective view for indicating a condition of the carriage portion before the ink tank is mounted in the ink tank according to the first embodiment of the present invention.
Figure 19:
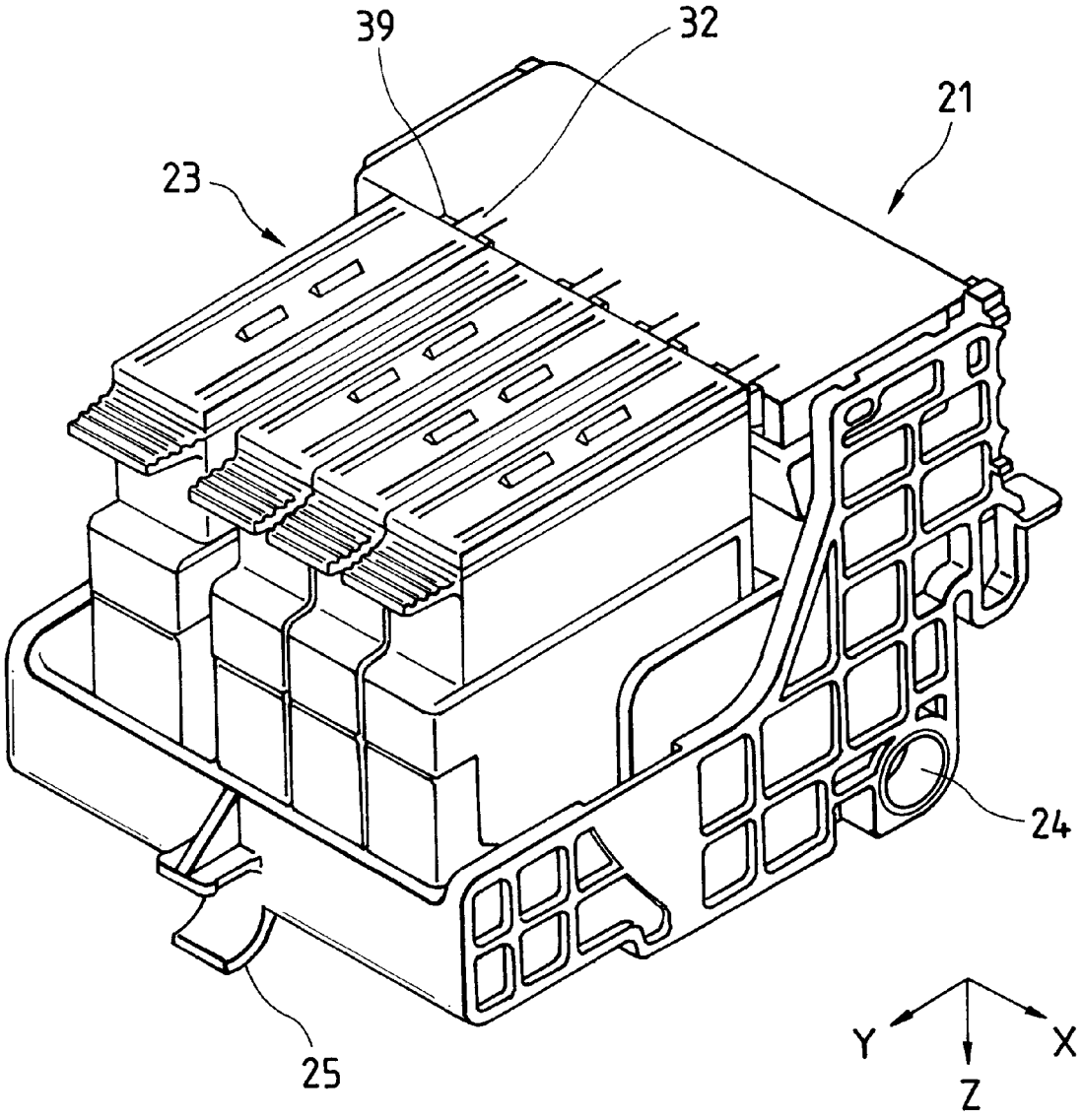
FIG. 19 is a perspective view for indicating a condition of the carriage portion after the ink tank is mounted in the ink tank according to the first embodiment of the present invention.
Figure 20:
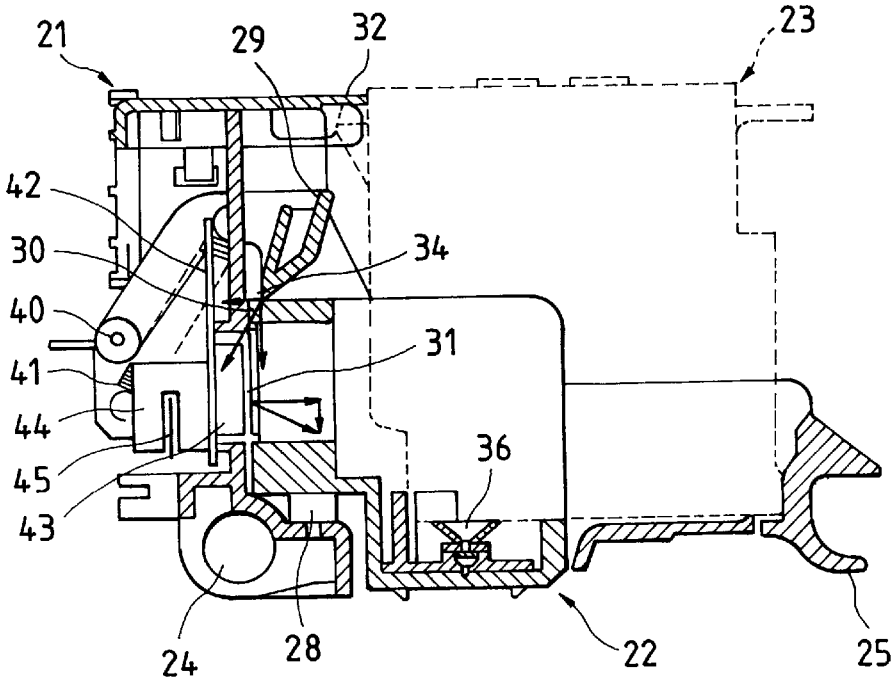
FIG. 20 is a sectional view for indicating a condition of the carriage portion after the ink tank is mounted in the ink tank according to the first embodiment of the present invention.

FIG. 17 to FIG. 19 are perspective views for representing one example of a carriage portion on which the ink tank according to the first embodiment of the present invention is mounted. FIG. 20 is a sectional view for similarly representing this carriage portion. Also, the ink tank according to the second embodiment is similarly mounted on this carriage. In the drawings, reference numeral 21 shows a carriage, reference numeral 22 denotes a print head unit, reference numeral 23 denotes an ink tank, reference numeral 24 shows a shaft hole, and reference numeral 25 indicates a guide blade receiver. Also, reference numeral 26 is an opening, reference numeral 27 indicates a projection receiver, reference numeral 28 shows a leaf spring, reference numeral 29 is a print head depressing lever, and reference numeral 30 denotes a print head abutting portion. Furthermore, reference numeral 31 shows a contact pin, reference numeral 32 indicates an ink tank pushing member, reference numeral 33 represents a projection, reference numeral 34 denotes a print head fixing unit, reference numeral 35 is a base plate, reference numeral 36 shows an ink conducting unit, reference numeral 37 is a head for black ink, reference numeral 38 shows a head for color ink, and reference numeral 39 denotes an engaging portion. Also, reference numeral 40 is a shaft, reference numeral 41 shows a spring, reference numeral 42 represents a contact board, reference numeral 43 is a connector, reference numeral 44 shows a position sensor, and reference numeral 45 is a timing fence.

On the carriage 21, the shaft hole 24 and the guide plate receiver 25 are provided, and are so arranged that these members can be transported by the main shaft and the guide plate of the main body of the recording apparatus. To assemble the print head unit 22, the opening 26 is formed at a center portion of the carriage 21, the projection receiver 27 is provided on both side walls, and the leaf spring 28 is provided on the bottom surface of the rear portion. The print head depressing lever 29 is pivotably fixed to the shaft 40 at their both ends, and is energized by the spring 41, as shown in FIG. 20. As indicated by a wide arrow of FIG. 20, when the print head unit 22 is mounted, the print head depressing lever 29 depresses the print head unit 22 against the print head abutting portion 30 along the oblique direction so as to energize this print head unit 22 along the Z direction and −Y direction (see FIG. 20). When the print head unit 22 is mounted the print head abutting unit 30 abuts against the print head fixing unit 34 of the print head unit 22, so that the print head unit 22 is positioned. In FIG. 17, there is shown such that a portion of the print head depressing lever 29 is cut away and the print head abutting portion 30 provided therein can be observed.

As indicated in FIG. 20, the contact board 42 is provided on the rear surface of the carriage 21, and is electrically connected to the main body of the recording apparatus via the flexible cable. The connector 43 is mounted on this contact board 43. The contact pin 31 of the connector 43 is such a portion used to be electrically connected to the print head unit 22. This contact pin 31 may supply the electric power and various sorts of signals supplied from the main body of the recording apparatus to the print head unit 22. The position sensor 44 is further provided on the contact substrate 42, which may sense the mark made on the timing fence 45.

The ink tank pushing member 32 is engaged with the engaging unit 39 of the ink tank 23 to stop the ink tank 23. In response to the depressing force of this ink tank pushing member 32, the ink tank 23 is depressed against to the ink conducting portion 36 of the print head unit 22 to thereby tightly close the connection portion between the ink tank 23 and the print head unit 22, so that a fluid communication can be established. The portion near this ink tank pushing member 32 is concaved by a size equal to the width of the engaging portion 39. The positioning operations along the X-direction and the Y-direction in this drawing are carried out by inserting the engaging portion 39 into this concave.

In the print head unit 22, such ink conducting portions 36 connected to the respective ink tanks 23 in the fluid manner, for receiving the ink supplied thereto are provided in the respective colors. In this case, these are provided the ink conducting portions 36 for receiving the black ink and the other three color ink. The black ink is supplied to the black color ink 37 and the other color ink is supplied to the color ink heads 38 among the ink received by this ink conducting unit 36. A large number of nozzles are arranged along the Y direction of this drawing in the black ink head 37 and the color ink heads 38. In the black ink head 37, the recording operation in the black color can be done by employing all of the arranged nozzles. In the color ink head 38, the arranged nozzles are subdivided into three groups, and the printing operations in the respective colors are performed by employing the nozzles belonging to the respective subdivided groups. An unused nozzle may be provided.

On the other hand, drive circuits for driving the black ink head 37 and the color ink head 38 are arranged with employment of the board 35 electrically connected to the contact pin 31 of the carriage 21. In this case, two sheets of boards 35 are employed in correspondence with the respective print heads. The board 35 may be made of a metal, for instance, and may be employed as heat sinks for radiating heat of the black ink head 37 and of the color ink head 38. The projection 33 is provided on the side surface of the print head unit 22, and the print head fixing unit 34 is provided at the upper portion thereof. This print head fixing unit. 34 is used when it is mounted on the carriage 21. The projection 33 is engaged with the projection receiver 27 of the carriage 21, by which the print head unit 22 is held and the positioning operation thereof is performed. The print head fixing unit 34 abuts against the print head abutting unit 30 of the carriage 21, and is depressed to be fixed by the print head pushing lever 29.

When the print head unit 22 is mounted on the carriage 21, the print head unit pushing lever 29 is pivoted in such a manner that this pushing lever 29 is picked up. On the other hand, the print head unit 22 is inserted from the upper portion of the carriage 21 in such a way that the black ink head 37 and the color ink head 38 of the print head unit 22 are exposed from the opening 26 of the carriage 21. At this time, when the print head unit 22 is inserted along a slightly inclined direction, this print head unit 22 can be easily inserted. Thus, the projection 33 of the print head unit 22 is inserted into the projection receiver 27 of the carriage 21 and then abuts against the deepmost portion thereof, so that the positioning operation of the print head unit 22 with respect to the front side is performed. Furthermore, the print head fixing unit 34 of the print head unit 22 abuts against the print head abutting portion 30 of the carriage 21, so that the print head depressing lever 29 is removed, and the carriage 21 is depressed along the Z direction and the −Y direction by way of the energizing force of the print pushing lever 29. The force directions at this time are indicated by wide arrows of FIG. 20. On the other hand, the print head unit 22 is mounted on the leaf spring 28 of the carriage 21, and is energized along the −Z direction in response to this elastic force, so that the print head unit 22 is fixed together with the print head depressing lever 29.

Furthermore, the contact pin 31 of the carriage 21 is electrically connected to the contact portion of the print head unit 22 (not shown). At this time, to achieve the stable electric connection, the contact pin 31 requires the depressing force against the contact portion of the print head unit 22 side. Also, the reaction force of the respective contact pins 31 requires approximately 80 gf at this time. For instance, assuming now that the number of signal lines is 15, the reaction force of the contact pin 31 requires approximately 1.2 Kgf in total. After the projection 22 of the print head unit 22 has been inserted into the projection receiver 27 of the carriage 21, the print head unit 22 is fixed by way of the print head depressing lever 29 of the carriage, so that the contact unit of the print head unit 22 is depressed to the contact pin 31 by a preselected force, and therefore the stable electric coupling can be achieved. In FIG. 20, this depressing force by the contact pin 31 is indicated by the wide arrow.

Generally speaking, in the case that a certain component is positioned so as to be assembled, when this component is positioned at 3 points in a first reference plane, at 2 points in a second reference plane, and at 1 point in a third reference plane, it is well known that the most stable arrangement can be obtained. In this arrangement, the positioning operation is carried out by the print head fixing portion 34 of the print head unit 22 and the print head abutting portion 30 of the carriage 21, and also the positioning operation is performed by the projections 33 located on both sides of the print head unit 22 and the projection receivers 27 located on both sides of the carriage 21 as to the Y direction. To carry out these positioning operations, the depressing force by the print head depressing lever 29 and the reaction force of the contact pin 31 are utilized. The print head depressing lever 29 produces the force along the directions from the Z direction to the −Y direction at angle of about 30 degrees. Then, this print head depressing lever 29 depresses. The print head unit 22 along the Z direction and the −Y direction to firmly achieve the abutment between the print head fixing portion 34 of the print head unit 22 and the print head abutting portion 30 of the carriage 21 for the positioning purpose. Also, the print head depressing lever 29 depresses the projections 33 of the print head unit 22 against the bottommost portion of the projection receivers 27 of the carriage 21 to thereby performing the positioning operation along the Z direction. Furthermore, the projection 33 of the print head unit 22 are depressed against the projection receivers 27 of the carriage 21 under stable condition along the Y direction by way of the reaction force exerted by the contact pin 31, so that the positioning operation along the Y direction at this portion can be done. As described above, the positioning operations along the Y direction and the Z direction may be carried out in higher precision. It should be noted that the positioning operation along the X direction may be performed by the projections 33 and the side surface of the carriage 21.

FIG. 18 represents such a condition that the print head unit 22 is assembled to the carriage 21. After the print head unit 22 has been assembled to the carriage 21, the ink tank 23 is mounted. In this case, the black ink tank and other three color ink tanks are mounted. As these ink tanks, the above-described ink tanks of the preferred embodiment may be employed. The engaging portion 39 is provided with each of the ink tanks 23. When the ink tank 23 is mounted, this ink tank 23 is inserted into a preselected position while grasping the handle portion of the ink tank 23. Then, the engaging portion 39 of the ink tank 23 is fitted to the ink tank pushing member 30 of the carriage 21, and the pressure is applied to the ink tank 23 against the print head unit 23 along the Z direction. Upon receipt of this pressure application, the joint port located at the lower surface of the ink tank 23 is made in contact with the respective ink conducting portions 36 of the print head unit 22, so that a highly closed ink flow path is fabricated.

Also, the lower portion of the front surface of the ink tank 23 abuts against the front portion of the carriage so as to perform the positioning operation along the Y direction. This positioning along the Y direction is also performed by the wall provided at the depth corner of the ink conducting portion 36 of the print head unit 22, and also the concave provided near the ink tank push member 30 of the carriage 21. Furthermore, the positioning operation along the X direction is also performed by the isolation wall formed around the ink conducting portion 36 of the print head unit 22 and the concave provided near the ink tank pushing member 30 of the carriage 21. In this example, a pawl is formed on the surface of the carriage 21, located opposite to the bottom surface of the ink tank 23. The ink tank 23 may be also depressed to be fixed by this pawl. In FIG. 19, there is shown such a condition that the four ink tanks 23 are mounted.

Figure 21:
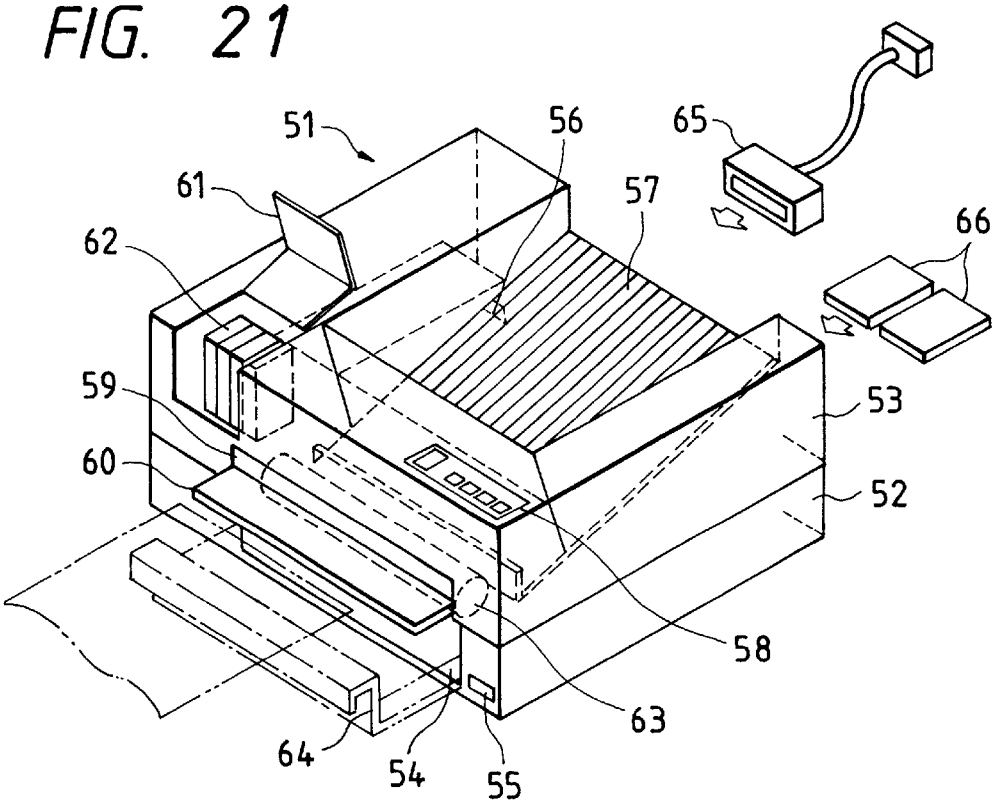
FIG. 21 is an outer view for indicating one example of a recording apparatus according to the present invention.

FIG. 21 is an outer view for showing one example of a recording apparatus. In this drawing, reference numeral 51 shows a recording apparatus, reference numeral 52 indicates a lower case, reference numeral 53 denotes an upper case, reference numeral 54 is a tray inserting port, and reference numeral 55 represents a dip switch. Reference numeral 56 is a main switch, reference numeral 57 represents a paper receiver, reference numeral 58 denotes a panel console, reference numeral 59 is a hand supply insert port, reference numeral 60 denotes a hand delivery tray, reference numeral 61 represents an ink tank inserting lid, reference numeral 62 shows an ink tank, reference numeral 63 indicates a paper feed roller, reference numeral 64 represents a paper tray, reference numeral 65 is an interface case, and reference numeral 66 shows a memory card.

A housing of the recording apparatus 51 is mainly constructed of a lower case 52 and an upper case 53. An electric circuit (not shown) and a drive system component (not shown either) are stored in this housing. The tray inserting port 54 is provided with the lower case 52, through which the paper tray 64 for storing therein a recording paper is inserted, so that the recording paper is set to the recording apparatus 51.

Also, the dip switch 55 and the main switch 56 are mounted on the lower case 52. The dip switch 55 is used to set a portion of the operations of the recording apparatus 51, and thus the functions which are not frequently changed are allocated to the dip switch 55. This dip switch 55 is so arranged as to be covered during no use condition. The main switch 56 is such a switch for turning ON/OFF the power supply of the recording apparatus 51. Furthermore, an, interface connector (not shown) and the insert port of the memory card 66 are provided in the lower case 52. The interface cable 65 is connected to the interface connector so as to transmit/receive data to/from an external computer. The memory card 66 may be employed as an expanded memory while the recording apparatus 51 is operated, and fonts are stored into this memory card 66 in order to be used during the recording operation.

The paper receiver 57 is formed n the upper case, into which the recorded paper is ejected. Also, the panel console 58 is provided with this upper case, on which input means and display means are arranged. The input means is frequently used by the user so as to set the recording mode and also instruct the paper supply and the paper ejection. The display means displays a message supplied from the printer. Furthermore, the hand inserting port 59 and the hand delivery tray 60 are provided on the upper case 53, through which the user can manually supply the paper.

The ink tank inserting lid 61 is provided with the upper case 53. The ink tank 62 can be mounted/removed by opening this lid, which is present within the upper case 53. As the ink tank 62, the ink tanks as explained in the respective embodiments of the present invention may be employed. In this case, the four ink tanks are mounted. As indicated in FIG. 17 through FIG. 20, the print head unit is mounted on the carriage, and furthermore, the ink tank 62 is mounted.

The paper stored in the paper tray 64 is transported one by one by way of an internal transport system (not shown) to be fed along the circumference of the paper feed roller 68. The print head (not shown in detail) on which the ink tank 62 is mounted is moved along a direction perpendicular to the transport direction of the paper, so that the printing operation is carried out with respect to each of band-shaped regions. Then, the paper is transferred along the longitudinal direction of this paper up to the next recording (printing) position having the band shape. Such an operation is repeatedly performed to perform the recording operation on the paper. Then, the printed paper is ejected onto the paper receiver 57 of the upper case 53.

In the above-described FIG. 17 to FIG. 21, there are shown the arrangements when the black ink and other three-color ink are employed to perform the recording operation. At this time, since the use frequency of the black ink is higher than that of other three-color ink, the capacity of the black ink may be made larger than the capacities of other three-color ink. Alternatively, it may be so arranged that only the three-color ink other than the black color ink may be employed, or more than 5 ink supply systems may be employed. Apparently, the present invention may be applied to a monochromatic recording apparatus. Furthermore, another arrangement may be employed in which print heads are provided with respect to the respective colors, other than the above-explained arrangements shown in FIG. 17 to FIG. 20 in which the black ink head 37 and two sets of the color ink heads 38. Obviously, the ink tank according to the present invention may be applied to various types of recording apparatuses in which while the recording medium is fixed, the recording head is transported along the X and Y directions, in addition to the above-explained recording apparatus where the recording operation is carried out while transporting the recording medium along the sub-scanning direction.

It should be understood that various modifications may be achieved in the above-described embodiments. First, both the atmospheric communication port 6 and the groove 14 in which the atmospheric communication port 6 is formed may be provided on not only the upper surface of the main ink chamber 2, but also other surfaces such as the side surface thereof. In this case, the capillary vessel member 3 is not in contact with the side surface under pressure, in which the atmospheric communication port 6 is provided. Also, the position of the communication holes 7 is not limited to the bottom surface of the main ink chamber 2, but may be formed on the side surface. At this time, if the atmospheric communication port 6 and the groove 14 are provided on the surface opposite to the surface where the communication holes 7 are formed, and furthermore are provided on such a surface whose interval is wide, then the ink may flow along one direction and thus there is a few place where the ink is reservoired. Accordingly, the ink can be effectively used. For example, in the case that the ink tank indicated in FIG. 1 is employed with being reversed, the above-explained shape may be achieved.

In the above-described embodiment, the atmospheric port 6 and the groove 14 are formed in the lid 13, but the present invention is not limited thereto. Since the ink tank 1 owns such internal spaces as the main tank chamber 2 and the intermediate ink chamber 4, this ink tank 1 should be arranged by a plurality of members. Alternatively, for example, in the case that both the atmospheric communication port 6 and the groove 14 are formed in the upper surface of the main ink chamber 2, the lid 13 may be formed on the side surface or the bottom surface. As previously explained, when the lid 13 is formed on the upper surface of the main ink chamber 2, the atmospheric communication port 6 and the groove 14 may be formed in the side surface.

Furthermore, the shape of the ink tank is the rectangular solid form in the above-explained embodiments. Alternatively, various shapes of the ink tanks may be arranged, for instance, a circular cylinder shape, a pyramid shape, and a doughnut shape. Moreover, the print head is separatably provided with the ink tank in the above-described embodiment, but the present invention is not limited thereto. Alternatively, the present invention may be applied to another case that the print head and the ink tank are formed in an integral form.

As apparent from the foregoing descriptions, according to the present invention, since the concave portion is formed in the peripheral surface containing the atmospheric communication port, the atmospheric air can be properly supplied to the capillary vessel member provided in the ink chamber. Accordingly, the amount of ink remaining in the capillary vessel member is reduced, and the ink contained in the capillary vessel member employed in the ink chamber can be utilized in the maximum efficiency. As a consequence, there is such an advantage that the using efficiency of the ink contained in the ink tank can be improved.

What is claimed is:

1. An ink tank for use with a capillary vessel member and connectable to a print head, comprising:

an atmospheric communication hole; and an inner wall surface for storing therein the capillary vessel member, a section of the inner wall surface defining a concave portion that communicates with the atmospheric communication hole, an area of the concave portion being equal to approximately half an area of the section of the inner wall surface defining the concave portion;

wherein a space to which air communicates is formed between said concave portion and the inner wall surface.

2. An ink tank connectable to a print head, comprising:

an ink tank having an inner wall and defining an atmospheric communication hole;

a capillary vessel member disposed in the ink tank, the capillary vessel member defining a concave portion that communicates with the atmospheric communication hole;

wherein a space to which air communicates is formed between said concave portion of the capillary vessel member and the inner wall of the ink tank.

3. An ink tank for supplying ink to a print head, comprising:

an ink chamber having a wall and an interior, the ink chamber being capable of reservoiring ink;

a communication port, provided at a portion of said ink chamber, for conducting the ink reservoired in said ink chamber;

an atmospheric communication port provided at a portion of the wall of the ink chamber and communicating with an external atmosphere, the atmospheric communication port supplying said external atmosphere to an interior of said ink chamber; and a capillary vessel member, stored within said ink chamber, capable of accommodating the ink; and a concave portion defined by the wall of the ink chamber and communicating with the atmospheric communication port, an area of said concave portion being equal to approximately half of an area of the surface of the wall of the ink chamber where said atmospheric communication port is provided;

wherein said atmospheric communication port is separated from said capillary vessel member by an air layer existing in said concave portion of the ink chamber.

4. An ink tank as claimed in claim 3, wherein a portion of the peripheral surface of said ink chamber containing said atmospheric communication port except said concave portion does not compress said capillary vessel member.

5. An ink tank as claimed in claim 3, wherein a compression degree of said capillary vessel member near said atmospheric communication port is lower than, or equal to a compression degree of said capillary vessel member near a center portion thereof.

6. An ink tank as claimed in claim 3, wherein said concave portion is provided at a portion of a surface located opposite to such a surface where said communication port of said ink chamber is formed.

7. An ink tank as claimed in claim 3, wherein said atmospheric communication port is provided on an upper surface of said ink chamber; and said concave portion, which is provided around said atmospheric communication port, is a groove formed along a longitudinal direction of said ink chamber.

8. An ink tank as claimed in claim 7, wherein the shape of said groove has a rectangular section.

9. An ink tank as claimed in claim 7, wherein an edge portion of said groove is selected from a group of shapes including arc and elliptical.

10. An ink tank as claimed in claim 7, wherein said groove has a shaped portion selected from a group of shaped portions including a cross-shaped portion, a partially widened portion, and a partially narrowed portion.

11. An ink tank for supplying ink to a print head, comprising:

a capillary vessel member capable of accommodating ink;

a lid defining an atmospheric communication port for supplying atmosphere, the lid also defining a groove around said atmospheric communication port of one surface thereof, an area of the groove being equal to approximately half of an area of the one surface of the lid; and an ink chamber for holding said capillary vessel member therein, a communication port for conducting the ink is provided in a lower portion thereof, and said lid is mounted at the ink chamber in such a manner that a surface of the lid defining said groove is located inside of the ink chamber;

wherein said atmospheric communication port is separated from said capillary vessel member by an air layer existing in said groove, while a portion of the lid other than the portion defining the groove contacts said capillary vessel member.

12. An ink tank as claimed in claim 11, wherein the shape of said groove has a rectangular section.

13. An ink tank as claimed in claim 11, wherein an edge portion of said groove is selected from a group of shapes including arc and elliptical.

14. An ink tank as claimed in claim 11, wherein said groove has a shaped portion selected from a group of shaped portions including a cross-shaped portion, a partially widened portion, and a partially narrowed portion.

15. An ink tank as claimed in claim 11, wherein said capillary vessel member is not compressed by a portion of the opposite surface of said lid other than said groove.

16. An ink tank as claimed in claim 11, wherein a compression degree of said capillary vessel member near said atmospheric communication port is lower than, or equal to a compression degree of said capillary vessel member near a center portion thereof.

17. An ink tank for supplying ink to a print head, comprising:

an ink chamber having a wall and an interior, the ink chamber being capable of reservoiring ink;

a communication port, provided at a portion of said ink chamber, for conducting the ink reservoired in said ink chamber;

an atmospheric communication port provided at a portion of the wall of the ink chamber and communicating with an external atmosphere, the atmospheric communication port supplying said external atmosphere to an interior of said ink chamber; and a capillary vessel member, stored within said ink chamber, capable of accommodating the ink; and a concave portion provided in a peripheral surface of said capillary vessel member opposite to said atmospheric communication port;

wherein said atmospheric communication port is separated from said capillary vessel member by an air layer existing in said concave portion.

18. An ink tank as claimed in claim 17, wherein the wall in which said atmospheric communication hole is provided is a portion of a lid.

19. An ink tank as claimed in claim 17, wherein the surface having the concave portion of said capillary vessel member is not compressed by the surface of the opposite wall.

20. An ink tank as claimed in claim 18, wherein the surface having the concave portion of said capillary vessel member is not compressed by the surface of the opposite wall.

21. An ink tank as claimed in claim 17, wherein a compression degree of said capillary vessel member near said atmospheric communication port is lower than, or equal to a compression degree of said capillary vessel member near a center portion thereof.

22. An ink tank as claimed in claim 18, wherein a compression degree of said capillary vessel member near said atmospheric communication port is lower than, or equal to a compression degree of said capillary vessel member near a center portion thereof.

23. An ink tank as claimed in claim 17, wherein said ink tank includes a meniscus forming member formed on said communication port, arranged in contact with said capillary vessel member, and in which a plurality of very small holes are formed.

24. An ink tank as claimed in claim 23, wherein said meniscus is made of a material selected from a group of materials including a mesh-shaped member and a porous body.

25. An ink tank as claimed in claim 23, wherein said meniscus has a shape selected from a group of shapes including circular and rectangular.

26. An ink tank as claimed in claim 21, further comprising:

an intermediate ink chamber corresponding to a small chamber under a highly sealed condition; and a communication path communicating with said communication port of said ink chamber, said intermediate ink chamber, and said print head.

27. An ink tank as claimed in claim 17, wherein said capillary vessel member is a porous material.

28. An ink tank as claimed in claim 17, wherein said capillary vessel member includes three-dimensionally branched filaments.

29. An ink tank as claimed in claim 17, wherein said capillary vessel member is a material spun in a three-dimensional shape.

30. An ink tank as claimed in claim 17, wherein said capillary vessel member is a bundled fiber material.

31. A recording apparatus that includes the ink tank as claimed in claim 1.

32. The ink tank as claimed in claim 1, further including a protecting member that prevents an exterior side of the atmospheric communication hole from being covered.

* * * * *